US009004758B2

(12) United States Patent
Frayne et al.

(10) Patent No.: US 9,004,758 B2
(45) **Date of Patent: *Apr. 14, 2015**

(54) INFLATABLE STRUCTURE FOR PACKAGING AND ASSOCIATED APPARATUS AND METHOD

(75) Inventors: Shawn Michael Frayne, Tampa, FL (US); Paul Chudy, New York, NY (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 337 days.

This patent is subject to a terminal disclaimer.

(21) Appl. No.: 12/603,280

(22) Filed: Oct. 21, 2009

(65) Prior Publication Data

US 2010/0101970 A1 Apr. 29, 2010

Related U.S. Application Data

(63) Continuation-in-part of application No. 12/256,245, filed on Oct. 22, 2008, now Pat. No. 8,272,510.

(51) Int. Cl.

| | |
|---|---|
| ***B65D 33/00*** | (2006.01) |
| ***B65D 30/24*** | (2006.01) |
| ***B65D 81/02*** | (2006.01) |

(Continued)

(52) U.S. Cl.

CPC ..... *B65B 55/20* (2013.01); *B31D 5/0073* (2013.01); *B65D 81/052* (2013.01); *B31D 2205/007* (2013.01)

(58) Field of Classification Search

CPC ..... B65D 81/05; B65D 31/145
USPC ..... 383/3, 44; 206/522
See application file for complete search history.

(56) References Cited

U.S. PATENT DOCUMENTS 2,799,314 A * 7/1957 Dreyer et al. ..... 383/44
3,207,420 A 9/1965 Navarrete-Kindelan (Continued)

FOREIGN PATENT DOCUMENTS

DE 39 22 802 A1 1/1991
DE 40 07 128 A1 4/1991

(Continued)

OTHER PUBLICATIONS

Office Action dated Feb. 7, 2012, for U.S. Appl. No. 12/256,245, filed Oct. 22, 2008.

(Continued)

*Primary Examiner* — Jes F Pascua
(74) *Attorney, Agent, or Firm* — Alston & Bird LLP

(57) ABSTRACT

An inflatable structure may be formed from a single piece of flexible film using a provided method of manufacturing. The inflatable structure may include quilting seals which divide the inflatable chamber. The inflatable structure may also include an external valve opening extending through multiple layers of the flexible film. The external valve opening may further be partially defined by edge portions of the flexible film formed by folding the flexible film. The external valve opening may be configured to align with an opening in a container or an inflation aperture in a pouch so that the inflatable structure can be inflated while inside the container/pouch. A corresponding inflation device fills the inflatable structure with air and may do so without requiring heat sealing or contact between the inflatable structure and outlet of the inflation device. A hinged plate apparatus may assist in directing air into the external valve opening.

7 Claims, 23 Drawing Sheets

(51) Int. Cl.

| | |
|---|---|
| ***B65B 55/20*** | (2006.01) |
| ***B31D 5/00*** | (2006.01) |
| ***B65D 81/05*** | (2006.01) |

(56) References Cited

U.S. PATENT DOCUMENTS

| | | | | | |
|---|---|---|---|---|---|
| 3,337,117 | A * | 8/1967 | Lehmacher et al. | 383/37 |
| 4,465,188 | A | 8/1984 | Soroka et al. | |
| 4,557,377 | A * | 12/1985 | Maloney | 206/219 |
| 4,949,530 | A | 8/1990 | Pharo | |
| 5,144,708 | A | 9/1992 | Pekar | |
| 5,263,587 | A | 11/1993 | Elkin et al. | |
| 5,308,163 | A | 5/1994 | Abe | |
| 5,348,157 | A | 9/1994 | Pozzo | |
| 5,351,828 | A | 10/1994 | Becker et al. | |
| 5,427,830 | A | 6/1995 | Pharo | |
| 5,454,642 | A | 10/1995 | De Luca | |
| 5,469,966 | A | 11/1995 | Boyer | |
| 5,515,975 | A | 5/1996 | Jarvis et al. | |
| 5,527,012 | A * | 6/1996 | Vinkel et al. | 249/61 |
| 5,581,983 | A | 12/1996 | Murakami | |
| 5,693,163 | A | 12/1997 | Hoover et al. | |
| 5,803,263 | A | 9/1998 | Pozzo | |
| 5,829,492 | A | 11/1998 | Gavronsky et al. | |
| 5,830,780 | A | 11/1998 | Dennison et al. | |
| 6,015,047 | A | 1/2000 | Greenland | |
| 6,276,532 | B1 | 8/2001 | Sperry et al. | |
| 6,311,740 | B1 | 11/2001 | Sperry et al. | |
| 6,569,283 | B1 | 5/2003 | Sperry et al. | |
| 6,913,803 | B2 | 7/2005 | Peper | |
| 6,978,893 | B2 | 12/2005 | Peper | |
| 7,165,677 | B2 | 1/2007 | Tanaka et al. | |
| 7,168,566 | B2 | 1/2007 | Anderson et al. | |
| 7,168,567 | B2 | 1/2007 | Peper et al. | |
| 7,201,273 | B2 | 4/2007 | Chen et al. | |
| 7,228,969 | B2 | 6/2007 | Nakano | |
| 7,297,387 | B2 | 11/2007 | Koyanagi | |
| 7,681,734 | B2 | 3/2010 | Liao et al. | |
| 7,828,146 | B2 | 11/2010 | Frayne | |
| 8,272,510 | B2 * | 9/2012 | Frayne et al. | 206/522 |
| 8,745,960 | B2 | 6/2014 | Kannankeril et al. | |
| 2002/0108351 | A1 | 8/2002 | Sperry et al. | |
| 2002/0153468 | A1 * | 10/2002 | Folkmar | 249/61 |
| 2002/0166788 | A1 | 11/2002 | Sperry et al. | |
| 2003/0108699 | A1 | 6/2003 | Tanaka | |
| 2003/0109369 | A1 | 6/2003 | Lerner et al. | |
| 2003/0139271 | A1 * | 7/2003 | Vangedal-Nielsen et al. | 493/162 |
| 2004/0022459 | A1 * | 2/2004 | Thomasset et al. | 383/44 |
| 2004/0211697 | A1 | 10/2004 | Nakano | |
| 2005/0109411 | A1 | 5/2005 | Koyanagi | |
| 2005/0139508 | A1 | 6/2005 | Su | |
| 2005/0189257 | A1 * | 9/2005 | Chen et al. | 206/522 |
| 2005/0236295 | A1 | 10/2005 | Perkins et al. | |
| 2006/0090421 | A1 | 5/2006 | Sperry et al. | |
| 2006/0191817 | A1 | 8/2006 | Nishi et al. | |
| 2006/0201960 | A1 | 9/2006 | Frayne | |
| 2006/0289108 | A1 | 12/2006 | McNamara et al. | |
| 2007/0056647 | A1 | 3/2007 | Frayne | |
| 2007/0065047 | A1 | 3/2007 | Kojima et al. | |
| 2007/0084745 | A1 | 4/2007 | Yoshifusa | |
| 2007/0090013 | A1 | 4/2007 | Yoshifusa et al. | |
| 2007/0131575 | A1 | 6/2007 | Abe | |
| 2007/0163916 | A1 | 7/2007 | Yoshifusa | |
| 2007/0170084 | A1 | 7/2007 | Chen et al. | |
| 2007/0295633 | A1 | 12/2007 | Liao et al. | |
| 2008/0073238 | A1 | 3/2008 | Liao et al. | |
| 2008/0280744 | A1 | 11/2008 | Tanaka et al. | |
| 2009/0297068 | A1 * | 12/2009 | Liao et al. | 383/3 |
| 2010/0096290 | A1 * | 4/2010 | Frayne et al. | 206/522 |

FOREIGN PATENT DOCUMENTS

| | | | | |
|---|---|---|---|---|
| DE | 296 12 426 | U1 | 10/1996 | |
| EP | 255780 | A2 * | 2/1988 | B65D 30/24 |
| EP | 2070838 | A1 | 6/2009 | |
| FR | 2711115 | A1 * | 4/1995 | B65D 30/24 |
| GB | 826784 | * | 1/1960 | |
| JP | 4-154571 | A | 5/1992 | |
| JP | 04154571 | A * | 5/1992 | B65D 81/10 |
| WO | WO 2011/002190 | A2 | 1/2011 | |

OTHER PUBLICATIONS

Office Action (Restriction) dated Dec. 23, 2009 of related U.S. Appl. No. 12/256,245.

Office Action dated May 10, 2010 of related U.S. Appl. No. 12/256,245.

Amendment filed Aug. 10, 2010 in response to Office Action dated May 10, 2010 of related U.S. Appl. No. 12/256,245.

Final Office Action dated Oct. 27, 2010 of related U.S. Appl. No. 12/256,245.

Request for Continued Examination and Amendment filed Jan. 26, 2011 in response to Final Office Action dated Oct. 27, 2010 of related U.S. Appl. No. 12/256,245.

Completed International Search Report and Written Opinion for PCT/US2009/061598 on Aug. 12, 2010.

Amendments Under Article 34 and Response filed in International Application No. PCT/US2009/061598 on Aug. 18, 2010.

Sealed Air Ultipack® Automated Void Containment System, *The Ultimate Solution for Automated Void Containment*, Distributed by Sealed Air Corporation (US), Elmwood Park, NJ, Oct. 2008.

International Search Report for PCT/US2009/061598 mailed Jan. 13, 2010.

United States Patent and Trademark Office, Notice of Allowance for U.S. Appl. No. 12/256,245, mailed Jul. 11, 2012, 11 pages, USA.

International Searching Authority, International Search Report and Written Opinion for International Application No. PCT/US2012/038025, mailed Oct. 29, 2012, 18 pages, European Patent Office, The Netherlands.

Free-Flow Packaging International, "Mini Pak'R® Air Cushion Machine, User Manual Revision 4.1, " Copyright © 2007-2012, USA.

European Patent Office, Extended European Search Report for Application No. 13191652.0, Dec. 11, 2013, 7 pages, Germany.

United States Patent and Trademark Office, Office Action for U.S. Appl. No. 13/109,410, Jun. 20, 2014, 18 pages, USA.

United States Patent and Trademark Office, Office Action for U.S. Appl. No. 13/109,410, Oct. 8, 2014, 8 pages, USA.

* cited by examiner

INFLATABLE STRUCTURE FOR PACKAGING AND ASSOCIATED APPARATUS AND METHOD

CROSS-REFERENCE TO RELATED APPLICATIONS

This application is a continuation-in-part of U.S. application Ser. No. 12/256,245, filed Oct. 22, 2008, now U.S. Pat. No. 8,272,510 which is hereby incorporated herein in its entirety by reference.

BACKGROUND OF THE INVENTION

1. Field of the Invention

The present invention generally relates to inflatable structures, and in particular to inflatable structures used in packaging and associated methods and apparatus.

2. Description of Related Art

Inflatable structures constitute an important part of the packaging industry. Inflatable structures are commonly used as cushions to package items, either by wrapping the items in the inflatable structures and placing the wrapped items in a shipping carton, or by simply placing one or more inflatable structures inside of a shipping carton along with an item to be shipped. The cushions protect the packaged item by absorbing impacts that might otherwise be fully transmitted to the packaged item during transit, and also restrict movement of the packaged item within the carton to further reduce the likelihood of damage to the item.

Inflatable packaging has an advantage over non-inflatable packaging in that inflatable packaging can require less raw material to manufacture it. Further, it is known within the art to make inflatable packaging such that it is inflatable on demand. Inflate-on-demand packaging allows the entity using the packaging materials to wait and inflate the packaging materials when needed, such as when shipping an item in a shipping container, as described above. This means that inflate-on-demand packaging materials occupy less space as compared to pre-inflated packaging materials, which makes them easier to store. Additionally, transportation of the packaging materials to the entity using them to package items can be less expensive than it would be if the packaging materials were already inflated because they can be shipped in significantly smaller containers.

Despite the advantages of inflate-on-demand packaging, there is still room for improvement within the art. This is because prior designs typically require the use of costly inflation devices that may be hard for the entity using the packaging materials to operate. In particular, many inflation devices heat seal the inflatable structure, which adds to the complexity and cost of such inflation devices. Further, many inflation devices also necessitate the insertion of an inflation wand into the valve of an inflatable structure, which can be difficult to accomplish, or they may also require careful machine-feeding of the uninflated packaging materials.

Accordingly, a need exists in the art for improved inflatable packaging structures and related inflation apparatus and methods that address the shortcomings of the prior art noted above.

BRIEF SUMMARY OF THE INVENTION

These and other advantages are provided by the inflatable structures presented herein, and which include an integral valve with two edge portions that may be formed from a single web of flexible film in an inline process. Such an inflatable structure and the associated apparatus and methods are capable of providing inflate-on-demand packaging that can be inflated using an inexpensive inflation device, and wherein such inflation is easy to do and does not require the use of an inflation needle, wand, or nozzle, or heat sealing by the entity using the packaging.

In particular, there is herein provided an inflatable structure for use in packaging comprising: at least one flexible film defining an enclosed chamber; at least one one-way valve defined at least in part by the flexible film for receiving pressurized air and thereby inflating the enclosed chamber, wherein the one-way valve comprises an external valve opening that is defined at least in part by edge portions of first and second layers of the flexible film, and further wherein the edge portions of the first and second layers of the flexible film are formed by folding the flexible film. In further respect to the invention, the one-way valve may include an internal edge portion. This internal edge portion can define a channel with one or more seals that join together the first and second layers of the flexible film. One or more slits extend through the seals so as to isolate the valve structure and make the valve resistant to leaking during movement of the inflatable structure. The seals may also be rounded proximate to the external valve opening so as to resist tearing of the flexible film at these locations. With regard to the internal edge portion, it can comprise a fold, a seal, or both a fold and a seal. One or more internal valve openings may be placed proximate to the internal edge portion. Additionally, the inflatable structure may define a planar direction, and the edge portions can be offset in the planar direction so as to facilitate the entry of air into the external valve opening during inflation.

The inflatable structure may include additional features such as sidewalls that extend from the edge portions and are connected to one another by one or more perimeter seals. Perforations can extend between the perimeter seals so as to allow for separation of the flexible film into multiple inflatable structures. Also, locator apertures can be defined between the perimeter seals for use in locating the valve of the inflatable structure proximate to the outlet of a source of pressurized air.

There is further herein provided an inflation device for inflating inflatable structures used in packaging, comprising: a holder for holding one or more inflatable structures; and a source of pressurized air for inflating the inflatable structure through a valve in the inflatable structure, the source of pressurized air further defining an outlet, wherein the holder holds the inflatable structure at a position such that the outlet of the source of pressurized air is spaced a distance from the inflatable structure to inflate the inflatable structure. As mentioned above the inflation device may further comprise a mechanical registration device wherein the valve in the inflatable structure is proximate to the outlet of the source of pressurized air when the mechanical registration device engages a locator aperture in the inflatable structure. The inflatable structure holder can be configured to dispense a substantially continuous web of inflatable structures, or it can comprise a clamp for holding a cartridge of inflatable structures. When the inflatable structure comprises a first edge portion and a second edge portion that are offset in the planar direction defined by the inflatable structure, the clamp can be configured to hold the second edge portion. Additionally, the holder can comprise a diverter for directing a flow of pressurized air from the outlet of the source of pressurized air toward the valve in the inflatable structure.

There is further herein provided a method of manufacturing an inflatable structure used in packaging, comprising: advancing at least one web of flexible film in a machine direction wherein the flexible film includes a first layer and a second layer joined together along at least one internal edge portion, cutting an aperture in at least one of the first layer and the second layer of the flexible film, sealing the first layer and the second layer of the flexible film together to define a valve, folding the first layer of the flexible film in a direction substantially perpendicular to the machine direction and thereby creating a first edge portion and a first sidewall of the flexible film, folding the second layer of the flexible film in the direction substantially perpendicular to the machine direction and thereby creating a second edge portion and a second sidewall of the flexible film, and sealing together the first sidewall and the second sidewall along one or more perimeter seals to define an enclosed chamber. The method can further comprise folding the flexible film in the direction substantially perpendicular to the machine direction to create the internal edge portion, sealing together the first layer and the second layer of the flexible film in the machine direction to create the internal edge portion, or a combination of both of these steps. The step of sealing together the first layer and the second layer of the flexible film to define the valve can comprise intermittently discontinuing the sealing to create the external valve opening.

Further, a slit may be formed along at least a portion of the seals defining the valve, which, as previously described, helps the valve to maintain a seal during movement of the inflatable structure. Additionally, another step may include perforating the flexible film proximate to the perimeter seals defining the enclosed chamber to allow for separation of the inflatable structures. Also, locator apertures may be formed in the flexible film proximate to the perimeter seals defining the enclosed chamber so as to assist in locating the valve near an outlet of a source of pressurized air during inflation. With regard to the rounded portions of the seals between the first and second layers of the flexible film, these may be created by spot sealing the first layer and the second layer of the flexible film together proximate to one or more ends of the seals defining the valve. Creation of the edge portions can occur through folding the first layer of the flexible film and folding the second layer of the flexible film and offsetting the first edge portion and the second edge portion in a planar direction defined by the inflatable structure. Additional steps can include cutting the web of flexible film proximate to the perimeter seals to create multiple inflatable structures, and connecting the second edge portions of the multiple inflatable structures to thereby form a cartridge of inflatable structures. Another step could include forming an aperture in the flexible film proximate to the internal edge portion to create the internal valve opening.

In additional embodiments the one-way valve may comprise an external valve opening at least partially extending through first and second layers of the flexible film which are sealed together surrounding at least a portion of the external valve opening. Such an external valve opening may be circular, or comprise a slit extending through the first and second layers of the flexible film. In other embodiments, edge portions formed by folding the flexible film may partially define the external valve opening, such as when the external valve opening is v-shaped. One or more cuts may extend from the external valve opening through the first and second layers of the flexible film where they are sealed together in order to create a sail.

Additionally, there is herein provided an inflatable structure for use in packaging in a container wherein the external valve opening is configured to be aligned with an opening in the container when the inflatable structure is placed in the container. A related method of inflating inflatable structures for use in packaging an item in a container comprises placing an inflatable structure in the container in proximity to the item to be packaged and spaced at a distance from the source of pressurized air, and filling the inflatable structure with a desired amount of the air from the source of pressurized air. One or more flaps of the container may be closed prior to the step of filling the inflatable structure, and the external valve opening may be aligned with a remaining open portion of the container which is created by the step of closing the one or more flaps. Thereby the source of pressurized air may be positioned outside of the container.

An apparatus configured to facilitate inflation of an inflatable structure is also provided. The apparatus comprises a base plate with an aperture therethrough and a hinged plate hingedly coupled to the base plate, wherein the aperture is configured to direct a flow of air through the aperture and toward an external valve opening and an outer surface of the inflatable structure and thereby create an area of low pressure between the outer surface of the inflatable structure and the hinged plate which aids in opening the external valve opening. The hinged plate may be configured to actuate a switch which shuts off the flow of air when the hinged plate hingedly pivots as a result of the inflatable structure filling with air.

Further embodiments of inflatable structures comprise at least one quilting seal connecting sidewalls defining the enclosed chamber. The at least one quilting seal may divide the enclosed chamber into two or more partially enclosed chambers. In other embodiments the at least one quilting seal may divide the enclosed chamber into at least one inflatable chamber and at least one uninflatable chamber. The inflatable structures may further comprising a valve position-retention seal configured to retain the position of the one-way valve, wherein the valve position-retention seal connects the one-way valve to the sidewalls to thereby prevent the one-way valve from being pushed out of the external valve opening.

An inflatable assembly for use in packaging is also provided. The inflatable assembly comprises a first inflatable structure and a second inflatable structure, with one or more connecting seals connecting the first inflatable structure and the second inflatable structure so as to form a partially enclosed cavity therebetween. The inflatable apparatus may further comprise an outer pouch with at least one inflation aperture therethrough, the inflation aperture aligning with the external valve opening when the first inflatable structure and the second inflatable structure are inserted into the outer pouch.

There is further herein provided a method of inflating inflatable structures used in packaging, comprising: holding an inflatable structure at a position such that an outlet of a source of pressurized air is spaced a distance from the inflatable structure, and filling the inflatable structure with a desired amount of the air from the source of pressurized air. Additional steps could include repeating the above steps until a desired number of the inflatable structures has been filled, and removing the inflatable structures that have been filled. Further, a mechanical registration device may engage a locator aperture in the inflatable structure when the valve is proximate to the outlet of the source of pressurized air. A later step could then include disengaging the locator aperture from the mechanical registration device when the inflatable structure is filled with the desired amount of air from the pressurized air source. Alternatively, or additionally, a visual indicator may be used to determine when the valve is proximate to the outlet of the source of pressurized air. Further, the step of removing the inflatable structures that have been filled can comprise tearing off the inflatable structures that have been filled from a continuous web of the inflatable structures, or unclamping the inflatable structures that have been filled from a cartridge of inflatable structures. Also, the flow of air from the source of pressurized air may be diverted to the valve using a diverter. Additionally, an inflatable structure may be deflated by inserting an elongate object through the valve, and later the inflatable structure may be re-inflated. With regard to the step of filling the inflatable structure with the desired amount of the air from the source of pressurized air, it may comprise restricting one or more dimensions of the inflatable structure, such as by using dimension restriction structures.

Further, a related method of manufacturing an inflatable assembly used in packaging is provided. The method comprises sealing together the first sidewall and the second sidewall along a plurality of perimeter seals to define a first enclosed chamber and a second enclosed chamber. The method further includes folding the flexible film proximate one of the perimeter seals to create a first inflatable structure comprising the first enclosed chamber and a second inflatable structure comprising the second enclosed chamber, and connecting the first inflatable structure and the second inflatable structure so as to define a partially enclosed cavity therebetween.

These and other aspects and features of the invention may be better understood with reference to the following description and accompanying drawings.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
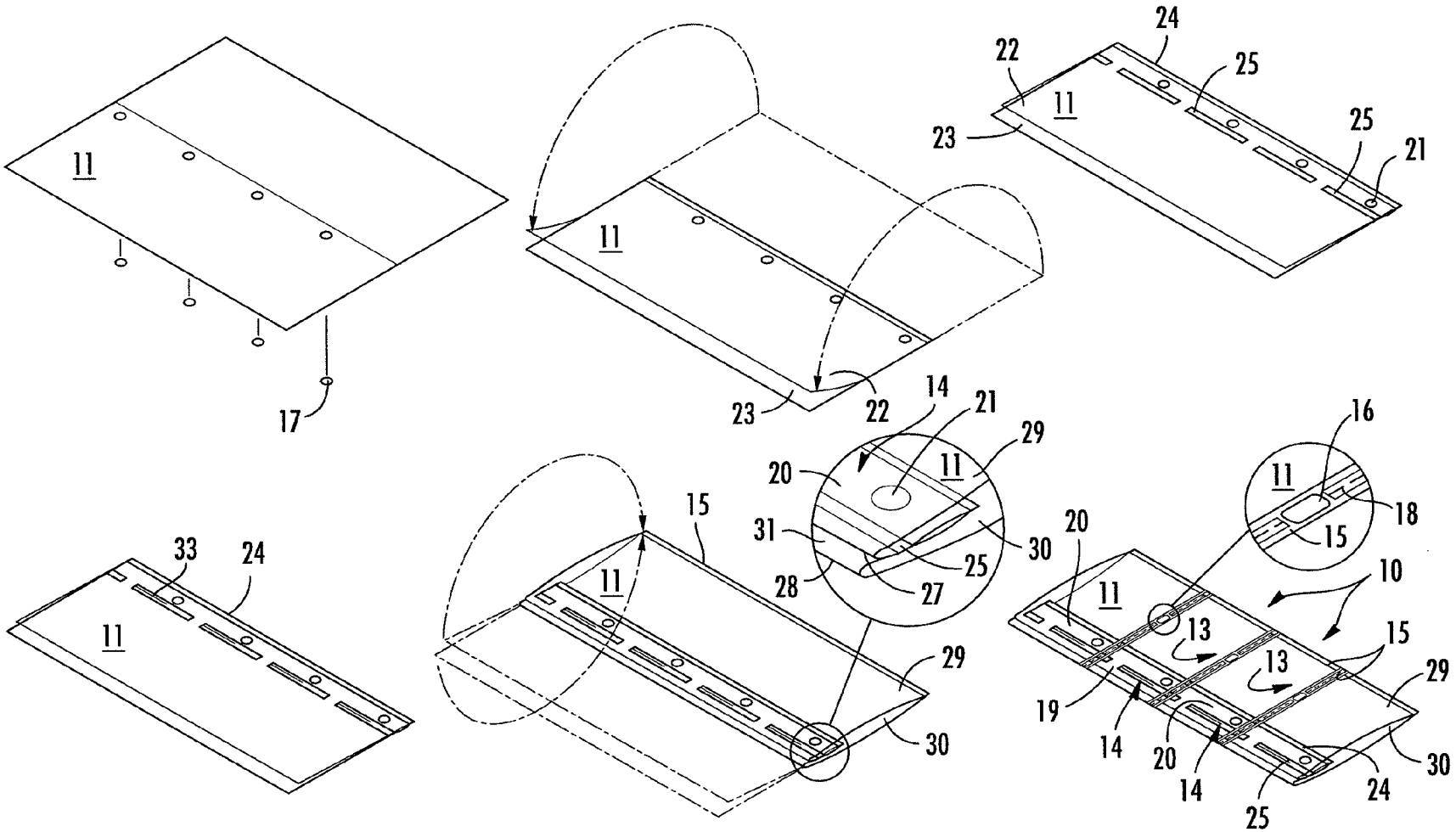
FIG. 1 is a perspective view of an embodiment of an inflatable structure with integral valve in various states of completion wherein the internal valve opening comprises a round hole and the locator aperture is rectangular in shape with rounded corners.

With reference to FIG. 1, there is provided an inflatable structure 10. In this embodiment, a single piece of flexible film 11 has been formed into multiple inflatable structures 10. The inflatable structures 10 may be formed advantageously from a unitary piece of flexible film 11 in an inline process or they may be formed from multiple pieces of flexible film. Methods of manufacturing the inflatable structures 10 will be discussed below.

As used herein, the term "flexible film" refers to a material that has the ability to change into a large variety of determinate and indeterminate shapes without damage thereto in response to the action of an applied force, and return to its general original shape when the applied force is removed. Flexible films 11 of a thickness of 1 or 2 mil can be used, although films of other thicknesses could alternatively be used. In particular, it may be possible to use flexible films 11 of even thinner thicknesses. This is because this type of inflatable structure 10 may be created in a tightly controlled manufacturing setting, such as the inline manufacturing process that will be described later. In contrast, other types of inflate-on-demand inflatable packaging typically require heat sealing in a packaging environment by the end user. In such a setting it is more difficult to control the heat sealing process, and hence thicker film may be required to allow for a margin of error.

Examples of flexible films 11 include various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethyl ene/alpha-olefin copolymers. Ethylene/alpha-olefin copolymers are copolymers of ethylene with one or more comonomers selected from C3 to C20 alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other materials are also suitable such as, e.g., polypropylene homopolymer or polypropylene copolymer (e.g., propylene/ethylene copolymer), polyesters, polystyrenes, polyamides, polycarbonates, etc. The flexible film 11 may be monolayer or multilayer and can be made by any known coextrusion process by melting the component polymer(s) and extruding or coextruding them through one or more flat or annular dies. Composite, e.g., multilayered, materials may be employed to provide a variety of additional characteristics such as durability, enhanced gas-barrier functionality, etc.

Returning to the embodiment shown in FIG. 1, the inflatable structure 10 generally comprises a flexible film 11 defining an enclosed chamber 13 and a one-way valve 14 defined at least in part by the flexible film. As used herein, "one-way" is meant to describe a valve 14 that allows fluid flow in one direction, but substantially impedes it in the opposite direction. However, the valve 14 may allow for flow in both directions if, for example, an elongated object is inserted into the valve. This therefore allows for the reusability of the inflatable structures 10 herein described. With regard to the enclosed chamber 13, it substantially encloses the valve 14 within perimeter seals 15. Some of the perimeter seals 15 have locator apertures 16 between them, which exist where portions of the flexible film 11 have been removed, or a slice in the flexible film has been made. As will be described later, these assist in the filling of the inflatable structures 10 with air. Some of the perimeter seals 15 further have perforations 18 between them such that individual inflatable structures 10 may be separated from other inflatable structures. The perimeter seals 15 may take the form of a double cross seal. Use of such a double cross seal or a single wide seal prevents the inflatable structure 10 from leaking at the locator aperture 16 and the perforations 18. Thus the locator apertures 16 are "between" the perimeter seals 15 in the sense that they are surrounded on both sides by at least a portion of a perimeter seal.

Figure 2:
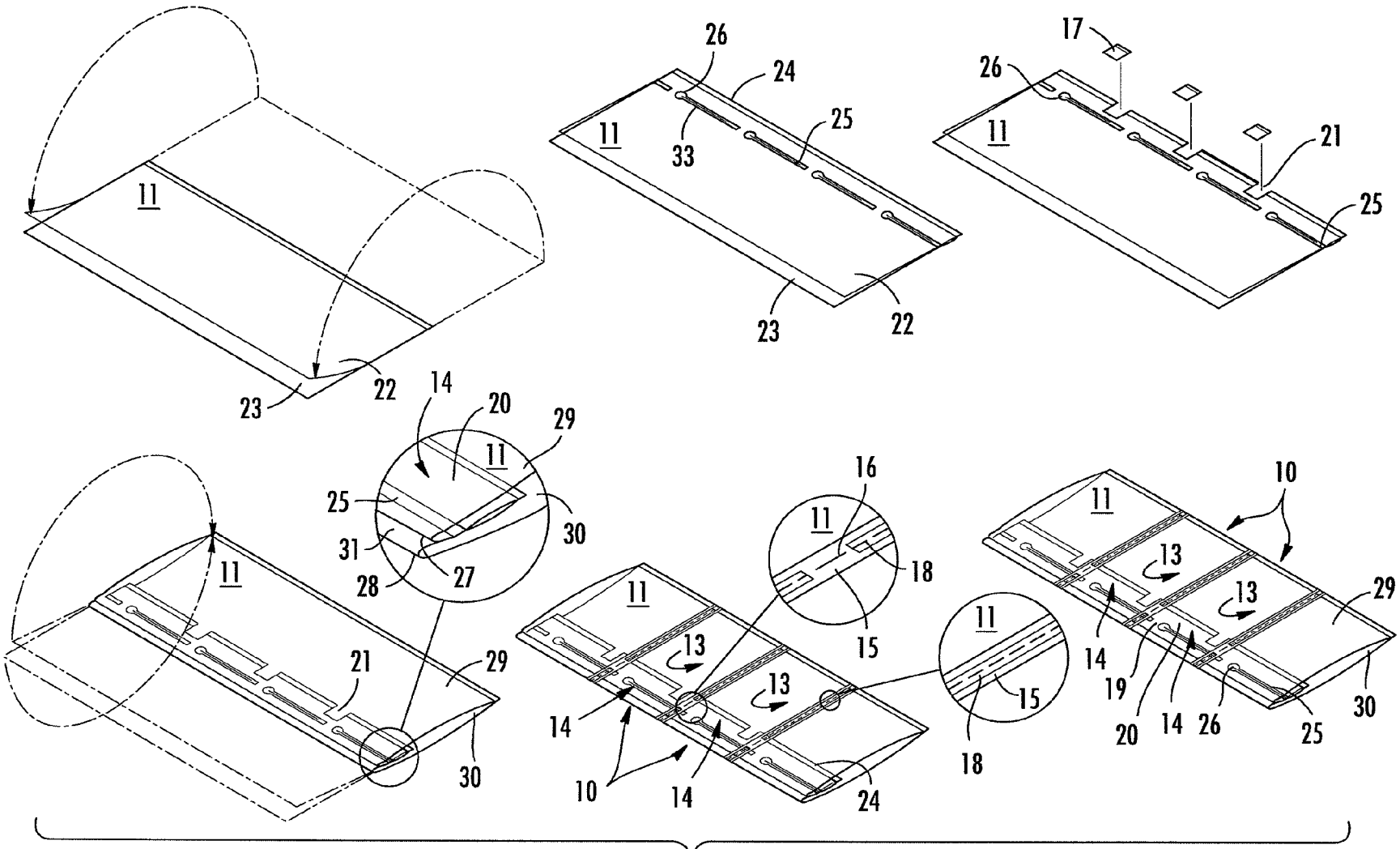
FIG. 2 is a perspective view of an embodiment of an inflatable structure with integral valve in various states of completion wherein the internal valve opening comprises a notch and the locator aperture comprises a slit.
Figure 3:
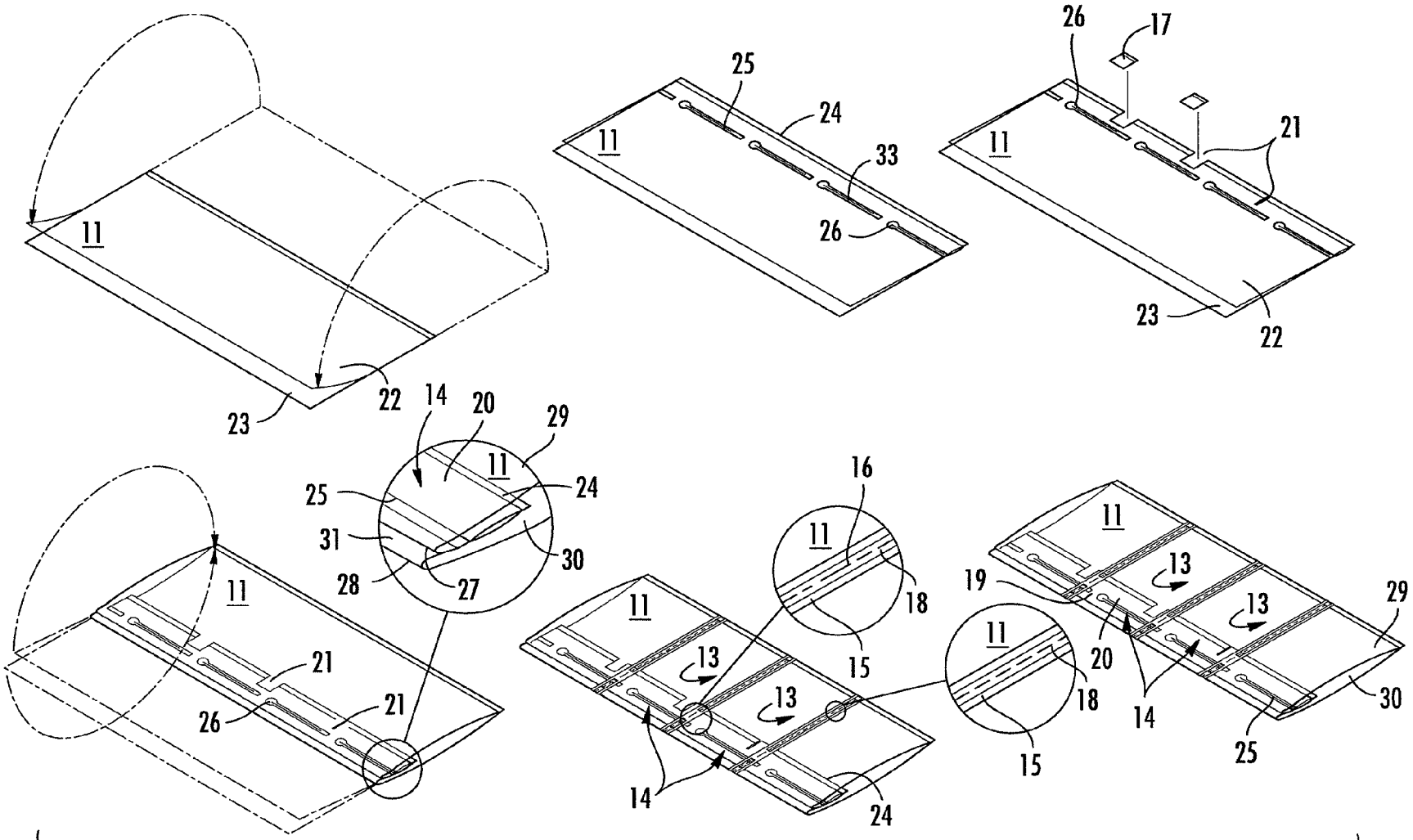
FIG. 3 is a perspective view of an embodiment of an inflatable structure with integral valve in various states of completion wherein internal valve openings comprise notches and a slit and wherein the locator aperture comprises a slit.
Figure 4:
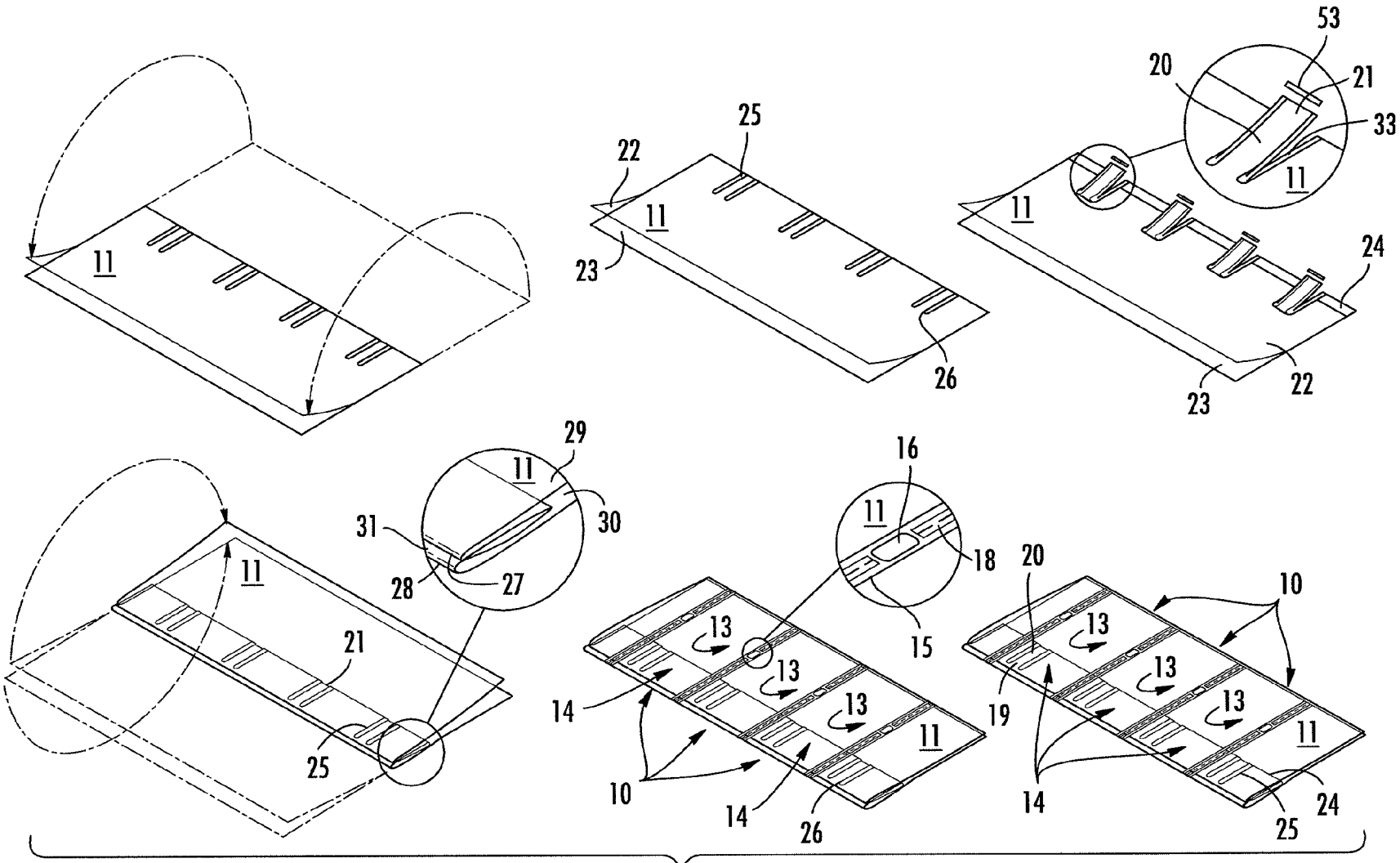
FIG. 4 is a perspective view of an embodiment of an inflatable structure with integral valve in various states of completion wherein the internal valve opening comprises a cut-off portion and wherein the seals run substantially perpendicular to the internal edge portion.
Figure 5:
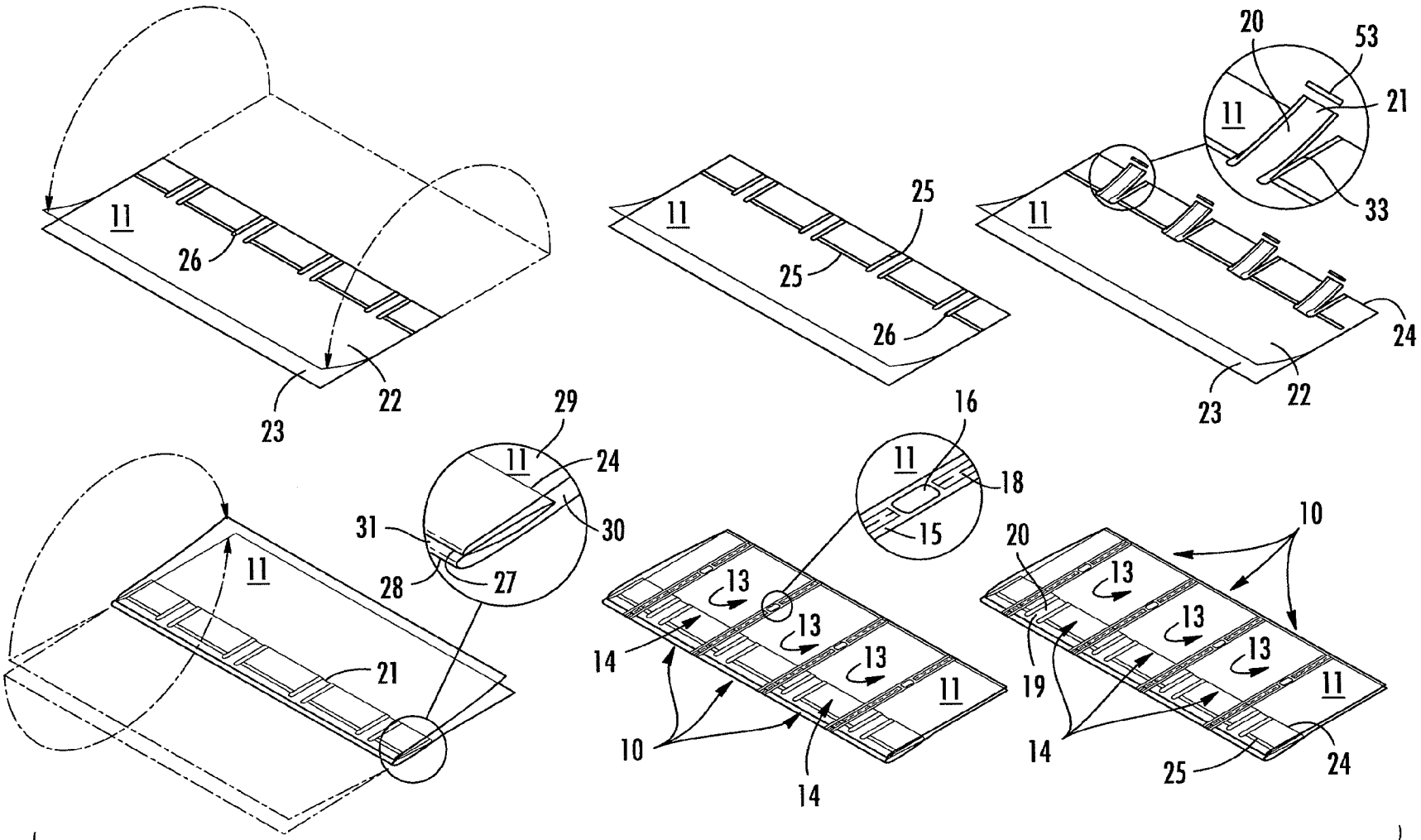
FIG. 5 is a perspective view of an embodiment of an inflatable structure with integral valve in various states of completion wherein the internal valve opening comprises a cut-off portion and wherein the seals run both substantially perpendicular to and substantially parallel with the internal edge portion.
Figure 6:
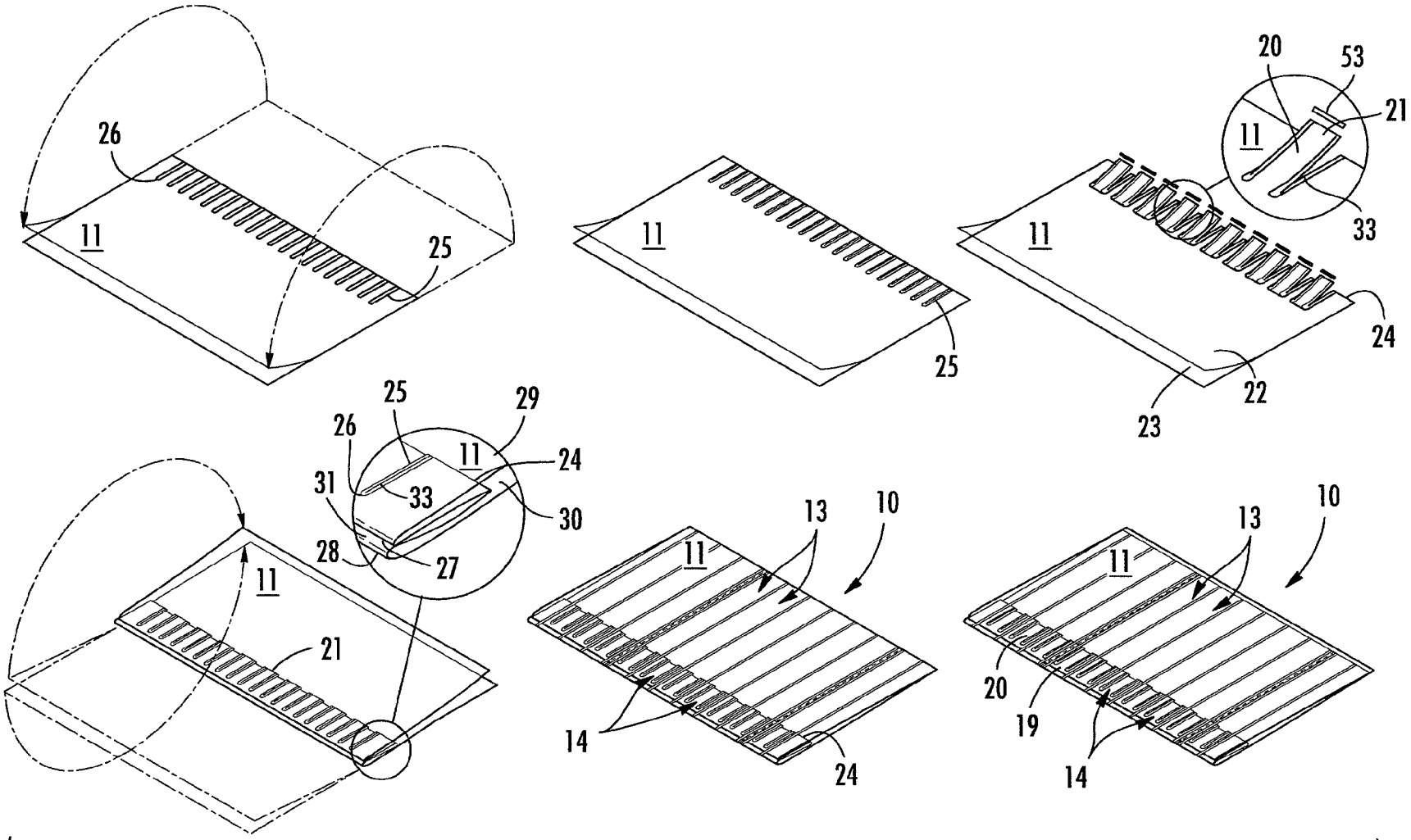
FIG. 6 is a perspective view of an embodiment of an inflatable structure with integral valve in various states of completion wherein there are multiple enclosed chambers in each inflatable structure.
Figure 7:
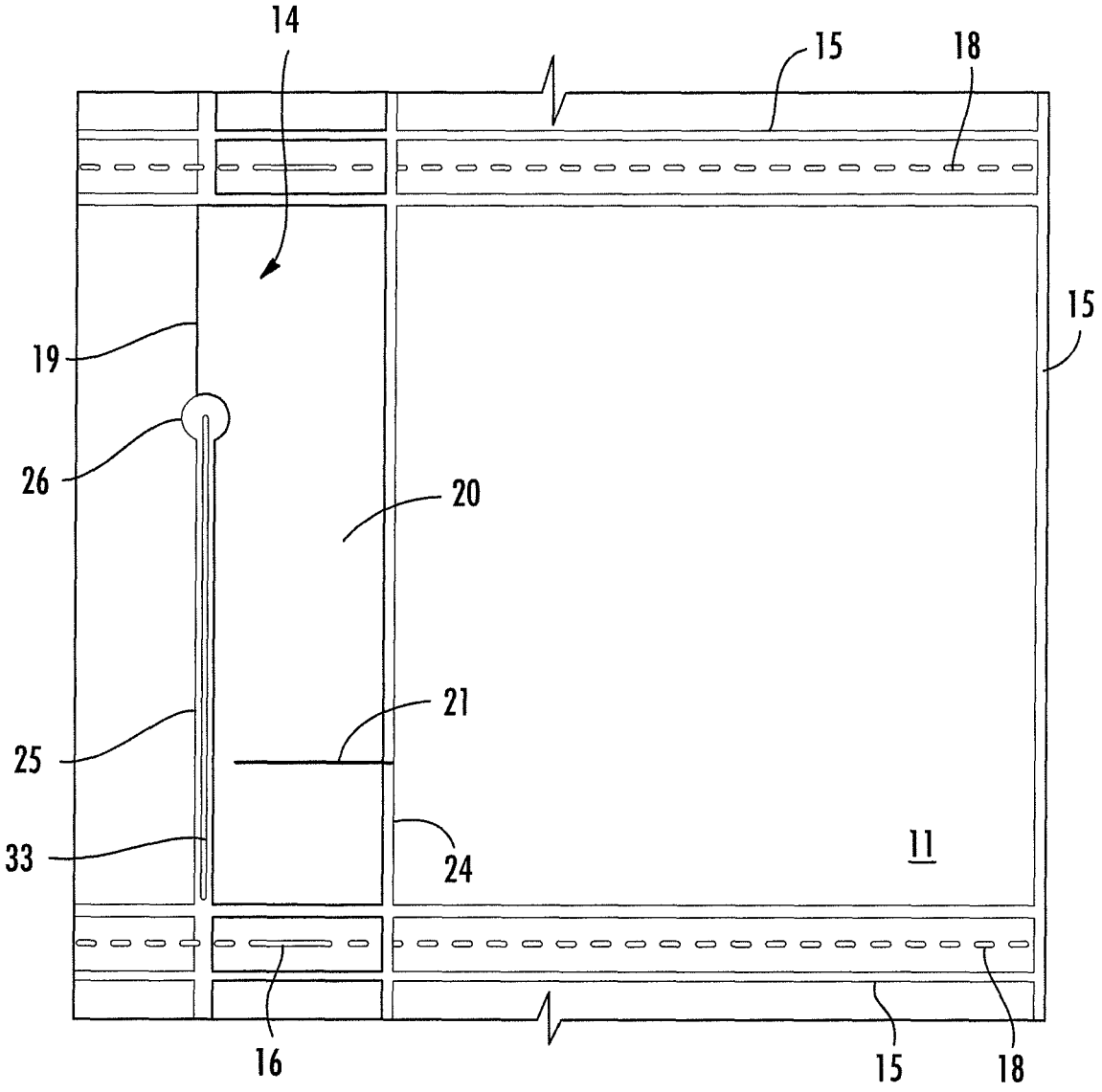
FIG. 7 is a top view of an embodiment of a completed inflatable structure with integral valve wherein the seal is rounded and the locator aperture comprises a slit.

The valve 14 itself has a number of elements. It is comprised of an external valve opening 19, which serves as an inlet, a channel 20, and an internal valve opening 21 which communicates with the enclosed chamber 13. The valve 14 is defined by a first layer 22 of flexible film 11 and an opposing second layer 23 of flexible film. The internal valve opening 21 may be comprised of a hole in the second layer 23 of the flexible film 11, as shown in FIG. 1. The internal valve opening 21 can also take a number of additional forms, such as a notch resulting from the removal of a scrap portion 17, as shown in FIGS. 2 and 3, or an edge resulting from the removal of a scrap portion 53, as shown in FIGS. 4, 5, and 6, or a slit, as shown in FIGS. 3 and 7. Thus, it can be seen that the internal valve opening 21 can be created in the first layer 22, the second layer 23, or both the first and second layers of the flexible film 11.

One side of the valve 14 is bounded by an internal edge portion 24 which can comprise a fold, a weld, or a combination of the two between the first layer 22 and the second layer 23 of the flexible film 11. The other side of the valve 14, which helps to define the channel 20, is bounded by discontinuous seals 25 between the first and second layers 22, 23. The discontinuity of the seals 25 forms an external valve opening 19 at locations where the seal does not exist. Thus, the external valve opening 19 is capable of communicating with the channel 20 and the internal valve opening 21.

The seals 25 may be formed in a variety of different ways. For example, they may run substantially parallel to the internal edge portion 24, as shown in FIGS. 1-3, 7, 8, 14, and 15, they may run substantially perpendicular to the internal edge portion, as shown in FIGS. 4 and 6, or they may run both substantially perpendicular to the internal edge portion and substantially parallel to the internal edge portion, as shown in FIG. 5. Further, the seals 25 may be rounded at a portion 26 proximate to the external valve opening 19, as shown in FIGS. 2-7 and 15. Rounding the seals 25 helps make the inflatable structures 10 more tear resistant by dispersing loads on the flexible film 11.

Additional features of the valve 14 include a pair of edge portions 27, 28. A first fold in the flexible film 11 results in the formation of first edge portion 27 and a sidewall 29 of the flexible film. A second fold in the flexible film 11 results in the formation of a second edge portion 28 and an additional sidewall 30 of the flexible film. The two sidewalls 29, 30 of the flexible film 11 then substantially envelop the valve 14 and form the enclosed chamber 13 by sealing together at least the two sidewalls with perimeter seals 15. The perimeter seals 15 may also seal together the first and second layers 22, 23 of the flexible film 11 to close off the valve 14 and prevent it from communicating with the valves of neighboring inflatable structures 10. Additionally, the second edge portion 28 can be offset from the first edge portion 27 in a planar direction defined by the inflatable structure 10. As most easily seen in FIG. 8, this arrangement creates a gutter 31 between the first and second edge portions 27, 28 which aids in filling the inflatable structure 10 with air. In particular, air flow 32 directed in a direction perpendicular to the planar direction or the inflatable structure will be deflected into the valve 14 by the edge portion extending further outwardly from the valve (e.g. edge portion 28 in FIG. 1).

Another feature that may be present in the valve is slits 33, which may be provided along the midline of the seals 25. The slits 33 function to separate the valve 14 from the rest of the inflatable structure 10 to some degree, and therefore help to prevent accidental discharge of the air from the enclosed chamber 13 of a filled inflatable structure when it is vibrated or otherwise disturbed.

An additional embodiment of the inflatable structure 10 is shown in FIG. 6. This embodiment is similar to the other previously described embodiments, but differs in that it uses multiple enclosed chambers 13 with corresponding valves 14. In other words, instead of having one valve 14 and one enclosed chamber 13 per inflatable structure 10, there are multiple valves and multiple enclosed chambers per inflatable structure. This is accomplished by using a narrower enclosed chamber 13 as well as perimeter seals 15 which do not extend between every enclosed chamber. This embodiment is configured to be used in wrapping items for shipment.

Figure 8:
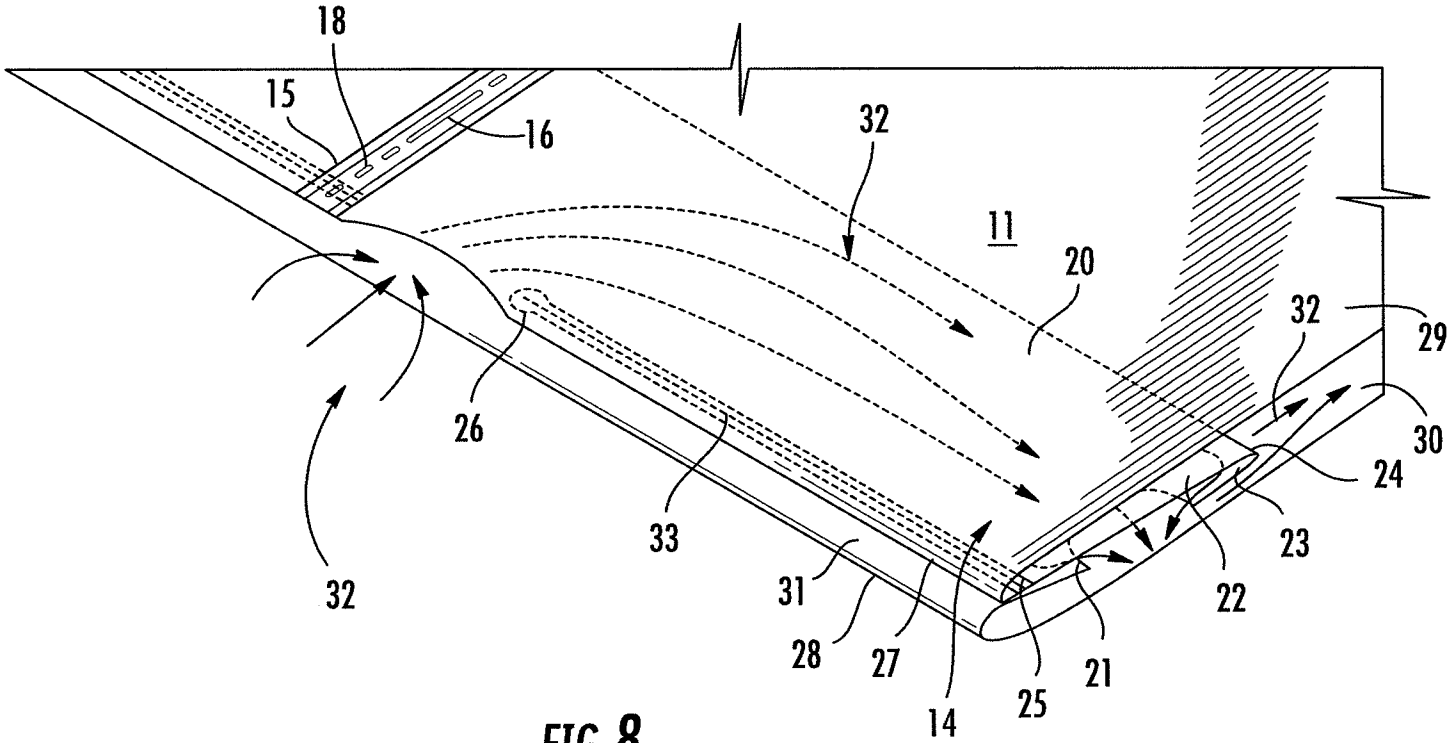
FIG. 8 is a cutaway view showing the inner portions of an embodiment of an inflatable structure and the air flow that occurs through the inflatable structure during inflation wherein the internal valve opening comprises a round hole.

The inflatable structures 10 discussed above are capable of inflation-at-a-distance. This means that the structure of the valve 14 allows air flow 32 to temporarily open the valve without necessitating contact between the inflatable structure 10 and any inflation wand, needle, nozzle, or other similar structure. Inflation-at-a-distance is depicted in FIG. 8 wherein the valve 14 is shown being opened by the air flow 32. Once the air flow 32 has ceased, or the valve 14 is moved out of the proximity of the air flow, the first and second layers 22, 23 of flexible film 11 seal together, which keeps the air sealed in the enclosed chamber 13.

After inflation and use, the inflatable structures 10 may be disposed of, reused, or recycled. When disposing of used inflatable structures 10, the volume of the inflatable structures may be reduced dramatically by either rupturing the inflatable structures or by releasing the air from each inflatable structure via the valve 14. If an elongated object, such as a pen or straw is inserted into the valve 14, the seal created by the valve can be temporarily broken. This action will lead to the release of air from the inflatable structure 10, thereby deflating it. Reuse of the inflatable structures 10 is relatively simple in that the inflatable structures can be re-inflated without necessitating the use of an inflation needle, as a person may simply blow towards the external valve opening 19 of the valve 14 to refill it.

Having described the features of the inflatable structures 10, methods of forming the inflatable structures will now be described. It is to be recognized that it is possible to form the claimed inflatable structures 10 in a number of ways. The following descriptions are meant only to provide examples of possible methods of forming the inflatable structures 10. In particular, the order of operations could be changed. Further, the particular manner of carrying out an operation could also be changed. However, it is of note that the manufacturing process may not require handwork for assembly. In contrast to many other types of inflatable packaging, the inflatable structures 10 can be created in an inline manufacturing process without requiring handwork, which greatly reduces production costs and production times.

Figure 9:
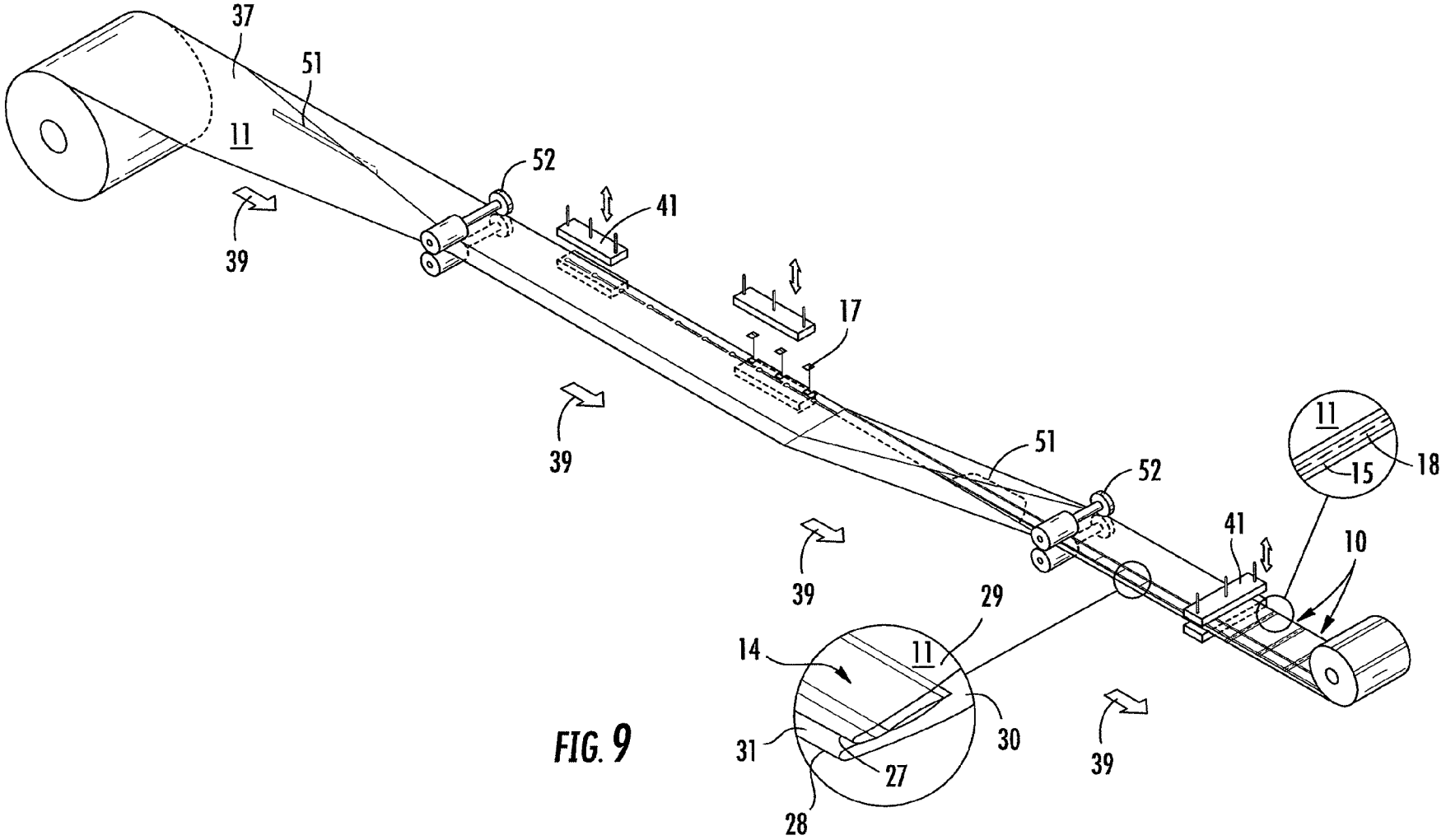
FIG. 9 is a perspective view of an embodiment of an inflatable structure inline manufacturing process.

One such method of forming an inflatable structure 10, as shown in FIG. 9 comprises advancing a continuous web 37 of flexible film 11 in a machine direction 39 and folding the flexible film in a direction perpendicular to the machine direction to create the internal edge portion 24. Such a fold may be created by using a folding plow 51. The internal edge portion 24 can alternatively be formed by sealing together two layers 22, 23 of flexible film 11, or by both folding and sealing together two layers of flexible film. Such a seal can be created using a rolling sealer 52. An additional step is to seal the first layer 22 of flexible film 11 and the second layer 23 of flexible film together to create seals 25 that define the valve 14. The internal valve opening 21 may be created by forming an aperture in either or both of the first and second layers 22, 23 of the flexible film 11 proximate to the internal edge portion 24. As previously discussed, this can comprise slicing a slit in the flexible film 11, punching out a hole or cutting off a scrap portion 17 to create a notch, or slicing off a scrap portion 53 of flexible film. Another step is to fold the first layer 22 of flexible film 11 and the second layer 23 of flexible film in directions substantially perpendicular to the machine direction 39 to create the first edge portion 27 and the first sidewall 29 of the enclosed chamber 13. Also, the second layer 23 of flexible film 11 is folded in a direction substantially perpendicular to the machine direction 39 to create the second edge portion 28 and the second sidewall 30 of the enclosed chamber 13. Folding plows 51 can be used to create these folds.

Further, the sidewalls 29, 30 may be sealed together to create perimeter seals 15 that form the enclosed chamber 13. A rolling sealer 52 and a sealing bar 41 may be used to create the perimeter seals 15. It is to be understood that the perimeter seals 15 do not have to be placed at the edges of the layers 22, 23 of the flexible film 11. Rather, "perimeter" is meant to describe the perimeter seals' function as to define bounds of the enclosed chamber 13. The perimeter seals 15 can be placed near the edges of the two sidewalls 29, 30 and they can also extend between what will then become two separate inflatable structures 10. The perimeter seals 15 may also seal together the first and second layers 22, 23 of the flexible film 11 so as to prevent the valve 14 from communicating with the valves of neighboring inflatable structures 10.

The perimeter seals 15 may further be perforated so as to allow for the separation of the inflatable structures 10 from one another. Also, locator apertures 16 may extend between the perimeter seals 15 so as to allow for engagement with a mechanical registration device 40, as will be described later. With regard to the location of the perforations 18 and locator apertures 16, they may extend directly through the sealed portion of the flexible film 11, or they may extend between two adjacent seals when, for example, the perimeter seals 15 comprise a double cross seal. Both such arrangements keep the perforations 18 and locator apertures 16 from piercing the enclosed chamber 13, which would inhibit the ability of the inflatable structure 10 to maintain an inflated state.

With regard to the seals 25 and perimeter seals 15, such terminology is meant to broadly cover various types of sealing arrangements. For example, they can include welds created by heat sealing or use of adhesive or cohesive bonds. It should then be understood that while specific terms have been applied to describe such joining arrangements, the terms are used in a generic and descriptive sense only, and not for the purposes of limitation.

With further regard to the seals 25 in particular, they may be discontinuous, as discussed above. Discontinuous seals 25 herein refer to seals that have breaks where the first layer 22 and second layer 23 of the flexible film 11 are not sealed to one another. The discontinuity may be the result of using a heat weld with portions of the first layer 22 of flexible film 11 and the second layer 23 of flexible film having a heat-resistant substance 34, such as heat resistant ink, between them. This results in the creation of the external valve opening 19 at the discontinuity. It is of note, however, that the channel 20 of the valve 14 itself may be formed without the use of heat-resistant ink. This is beneficial since most heat-resistant inks develop a small amount of tackiness when heat is applied. This tack is usually not an issue when inflatable structures 10 with more conventional valves are concerned, since a rigid structure such as an inflation needle is typically used to force open the valve channel prior to inflation. However, when performing inflation at a distance, air pressure opens the valve channel 20. Therefore, in order to reduce the air pressure needed to accomplish this, any potential source of tack should be reduced.

This is accomplished in the present valve 14, which does not require heat resistant ink in the channel 20 of the valve. In particular, the machine seal 25 of the present invention can be made in a discontinuous manner by using a heated roller with gaps in the sealing surface corresponding to the discontinuities. A heated sealing bar 41 with gaps in the sealing surface corresponding to the discontinuities could also be used, or a sealing bar without gaps in the sealing surface could be used in conjunction with another type of heat resistance substance such as pieces of TEFLON® placed at each discontinuity. Alternatively, a heated sealing bar 41 without gaps could be used, in combination with an intermittent advance of the flexible film 11 which may be accomplished by a variety of known means such as by application of a dancer bar, to allow for a discontinuous seal 25.

Further, the seals 25 may have a rounded portion 26, as previously discussed, which helps to prevent tears of the flexible film 11. This can be created by spot sealing the first layer 22 of the flexible film 11 to the second layer 23 of the flexible film proximate to the end of a seal 25. Also, an additional step can include slicing a slit 33 into the seals 25. As previously discussed, this helps to keep the valve 14 from accidentally opening.

Figure 14:
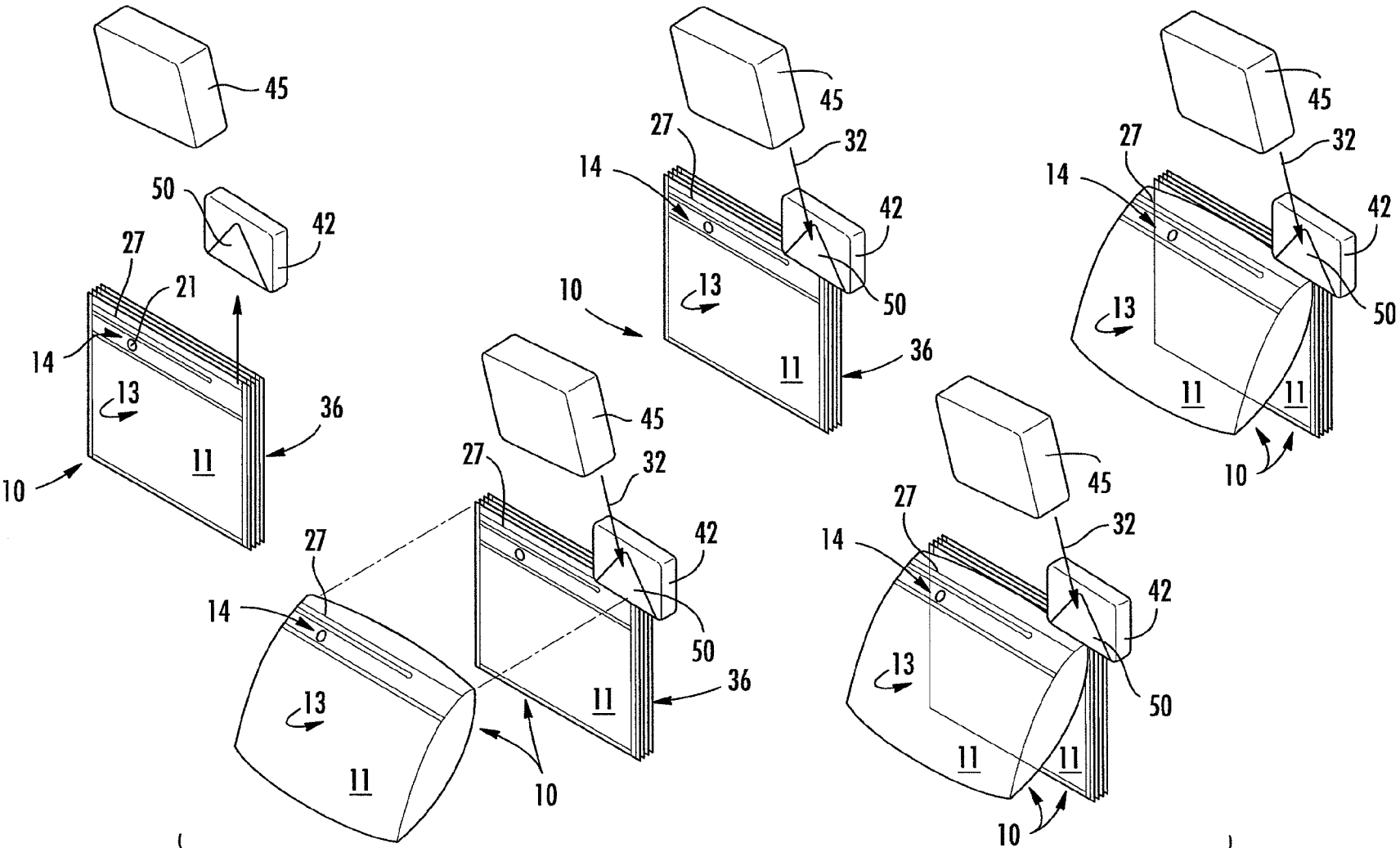
FIG. 14 is a perspective view of an embodiment of a cartridge-based inflatable structure inflation device in operation wherein the holder comprises a clamp.
Figure 15:
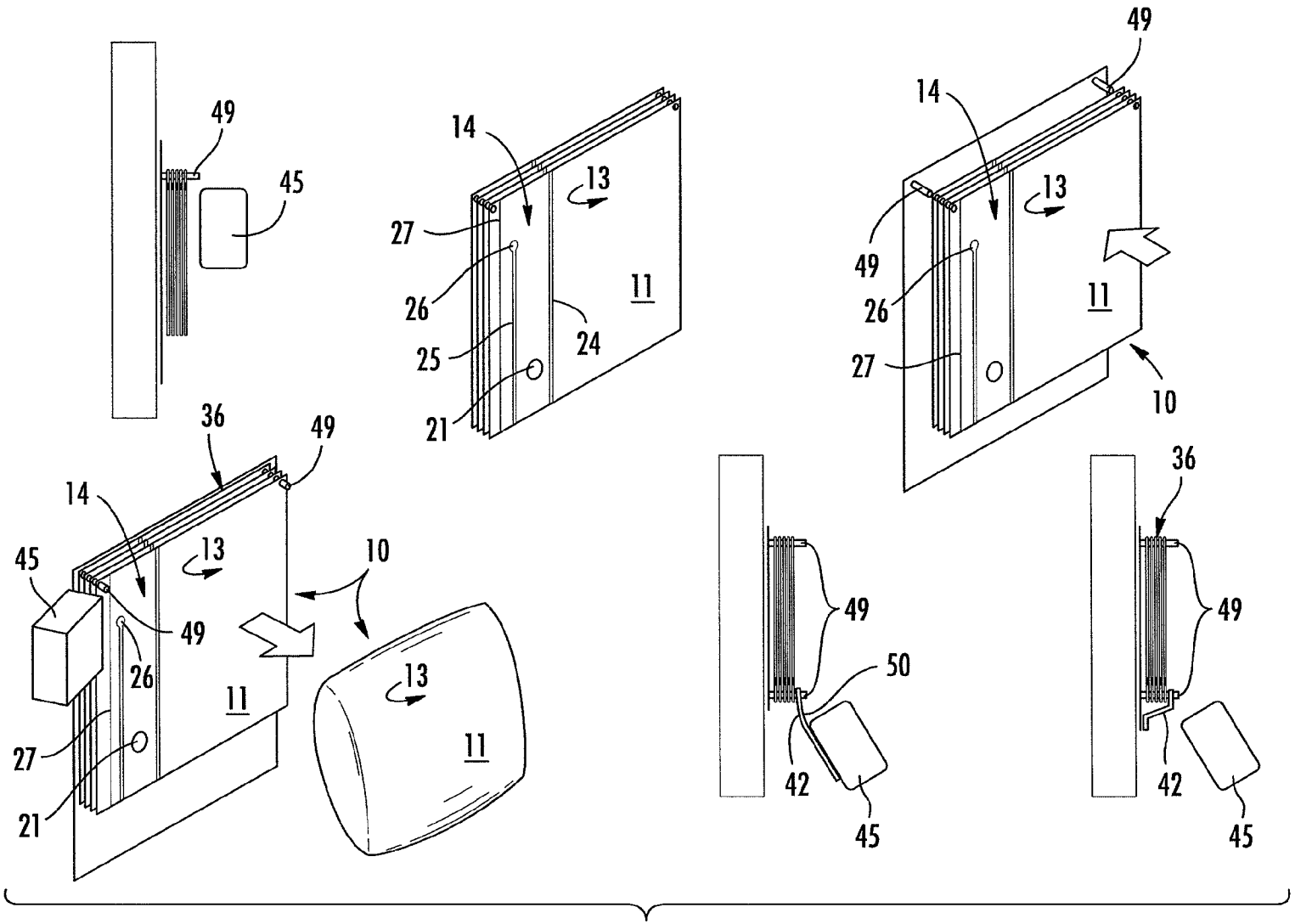
FIG. 15 is a perspective view of an embodiment of a cartridge-based inflatable structure inflation device in operation wherein the holder comprises pins.
Figure 16:
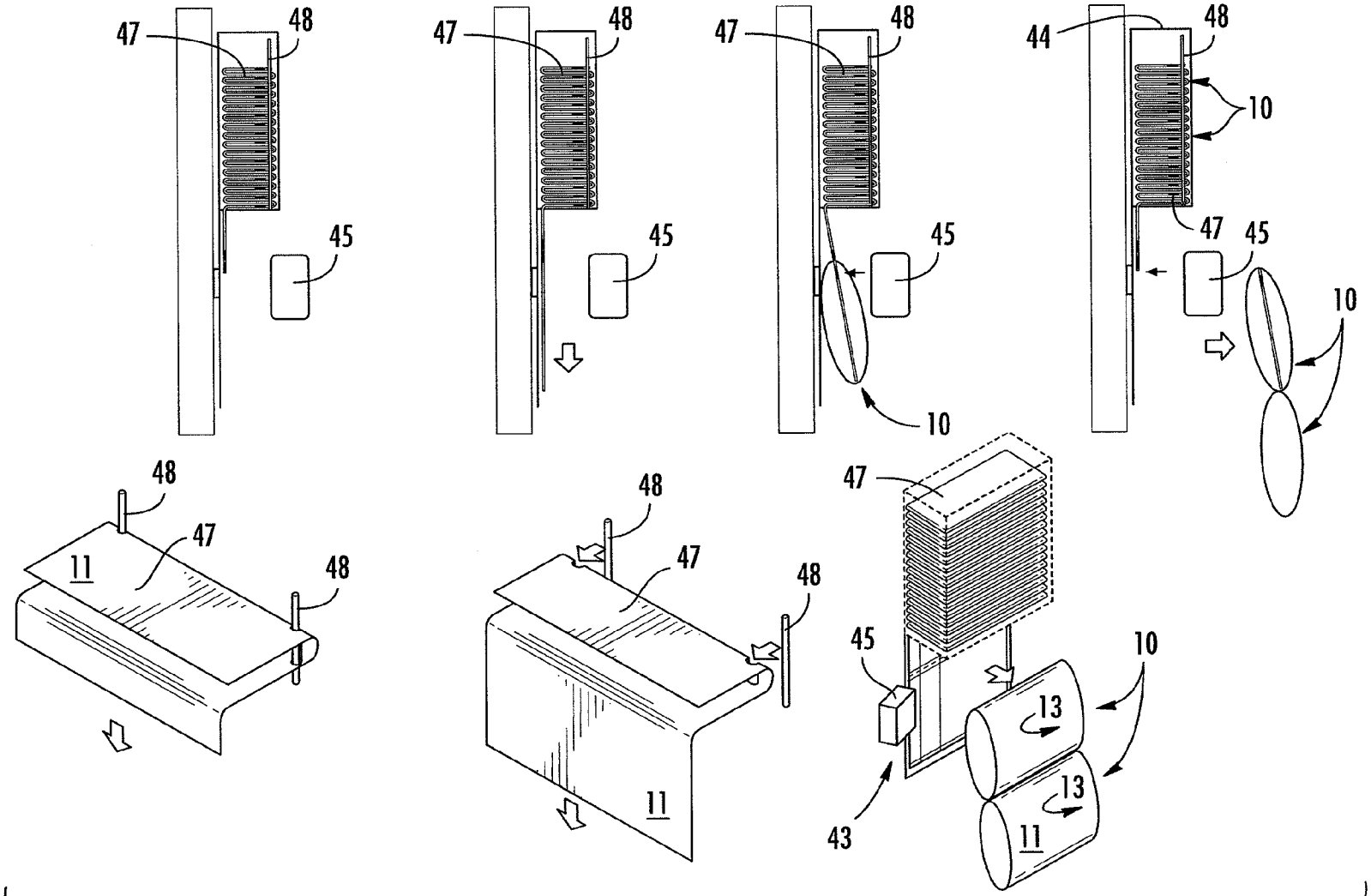
FIG. 16 is a perspective view of an embodiment of a fold-based inflatable structure inflation device in operation.

The finished product from the above described process may take the form of a continuous web of inflatable structures 10. Such a continuous web may then be packaged in a number of different manners so as to be ready for use. One such manner is to roll the continuous web into a roll 38, as shown in FIGS. 10-13. Another way to package the inflatable structures 10 is to fold them into a folded form 47, as shown in FIG. 16. Alternately, the continuous web may be cut into individual inflatable structures 10, and then connected together in the form of a cartridge 36, as shown in FIGS. 14, and 15. In one such embodiment, the second edge portion 28 of an inflatable structure 10 may be attached to the second edge portion of additional inflatable structures, as shown in FIGS. 14 and 15. Such cartridges 36 can be held together by a holder 42, which can take the form of a clamp, staple, rod, etc. If a holder 42 such as a staple is used, the holder can extend through a portion of the inflatable structure 10 other than the sidewalls 29, 30 so as to not puncture the enclosed chamber 13.

It is of note that these methods of inflatable structure 10 manufacturing may not require hole-alignment between different webs of flexible film 11. Elimination of this step is advantageous in that this is otherwise a difficult step in high-speed manufacturing.

An inflatable structure 10 inflation device 43 will now be discussed. With reference to FIGS. 10-13, there is pictured an embodiment of an inflation device 43. The inflation device 43 is comprised of a housing 44, an inflatable structure holder 42, and a source of pressurized air 45 with an outlet 46. The inflatable structure 10 inflation device 43 of this embodiment is designed to dispense a continuous web of inflatable structures, shown in FIGS. 10-13 as a roll 38 of inflatable structures. Other forms of webs of inflatable structures 10 could also be inflated such as a folded form 47 of the inflatable structures as shown in FIG. 16.

Figure 10:
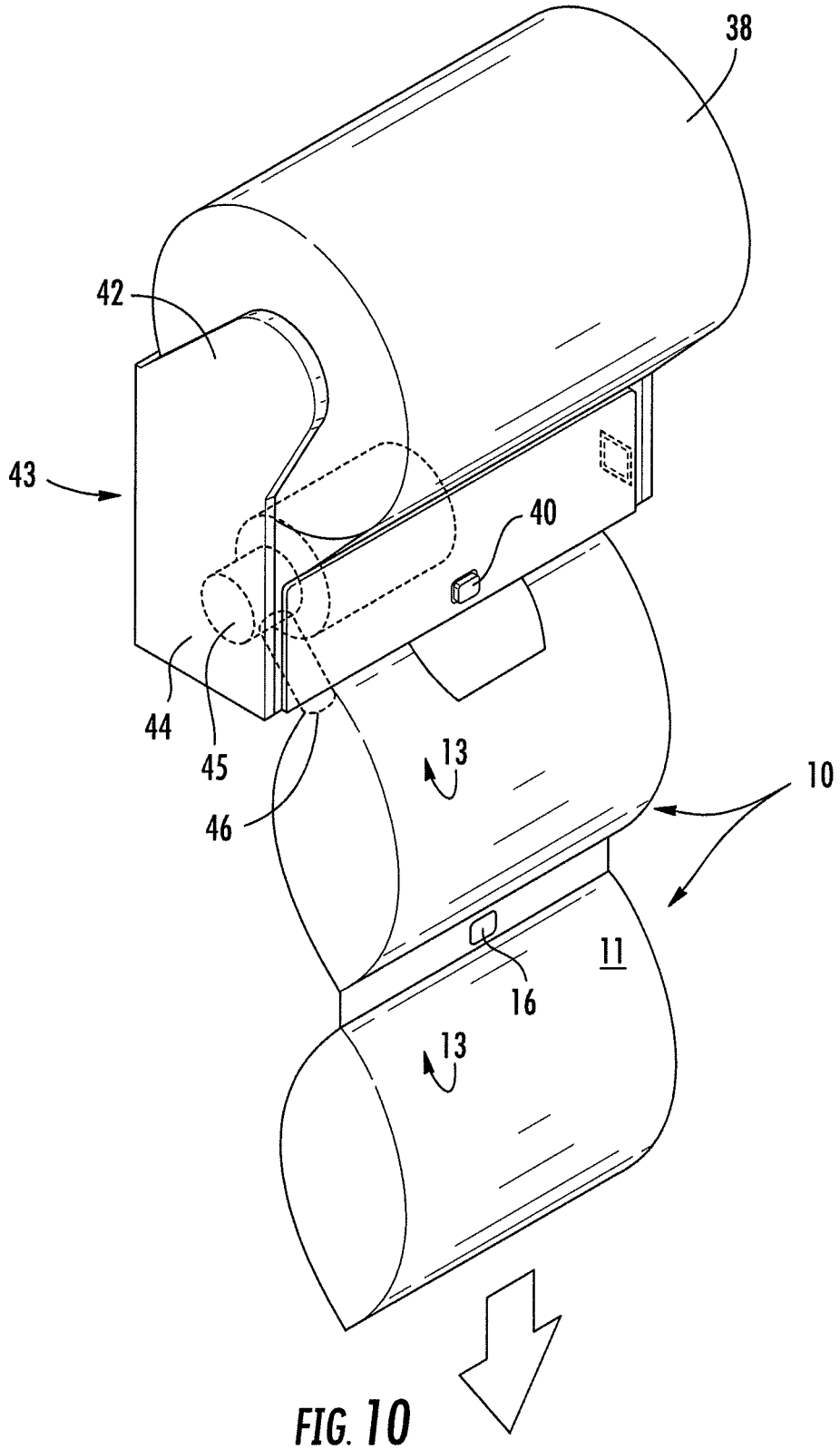
FIG. 10 is a perspective view of an embodiment of an inflatable structure inflation device with mechanical registration device for use with a roll of inflatable structures.
Figure 13:
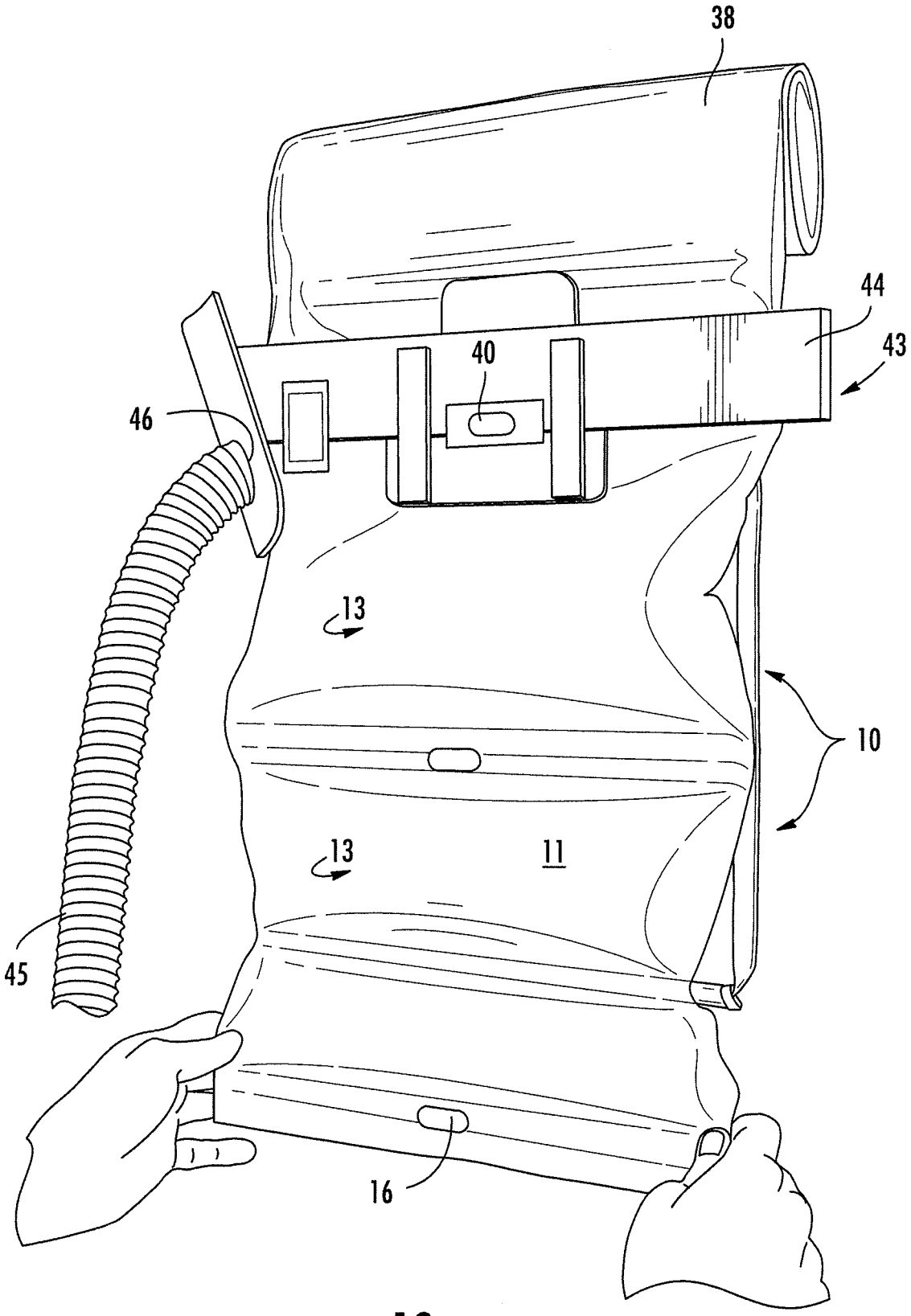
FIG. 13 is a perspective view of an embodiment of a wall-mounted roll-based inflatable structure inflation device in operation wherein the source of pressurized air is distant from the outlet.

As seen in FIGS. 10 and 13, the inflation device 43 may further include a mechanical registration device 40 for engaging locator apertures 16 in the inflatable structures 10. The mechanical registration device 40 and locator apertures 16 can take a number of different corresponding forms. For example, the locator aperture 16 could be a slit, as shown in FIGS. 2, 3, and 7 or a rectangular shape with rounded corners, such as is shown in FIGS. 1, 4, 5, and 13. The mechanical registration device 40 takes a corresponding shape such as the rectangular embodiment with rounded corners as shown in FIG. 13, so as to temporarily engage the locator aperture 16 and hold the inflatable structure 10 in place.

In operation, the outlet 46 of the source of pressurized air 45 is proximate to the valve 14 when the inflatable structure 10 holder 42 dispenses the inflatable structure. This can be facilitated through use of the mechanical registration device 40. The mechanical registration device 40 temporarily engages locator apertures 16 which may be located in the perimeter seals 15 separating multiple inflatable structures 10. Hence the mechanical registration device 40 temporarily holds an inflatable structure 10 in such a position so as to allow for the outlet 46 of the source of pressurized air 45 to be near the valve 14 of the inflatable structure 10 and fill it with air. Alternatively, a visual indicator may be used to determine when the valve 14 is proximate to the outlet 46 of the source of pressurized air 45. For example, a line can be drawn on the inflatable structure 10 that matches up to a line on the inflation device 43 when the valve 14 is proximate to the outlet 46 of the source of pressurized air 45. Alternatively, an indicator on the inflation device 43 may line up with the perimeter seals 15 separating multiple inflatable structures 10. Various other such visual indicators may also be used.

This embodiment and the other embodiments shown and described in this application are all designed to allow for inflation-at-a-distance. This means that the outlet 46 of the source of pressurized air 45 and the inflatable structure 10 do not have to have any physical contact. The air flow 32 alone is capable of opening the valve 14 and filling the inflatable structure 10 without necessitating the use of an inflation needle, wand, nozzle, or other similar structures.

In this previously described embodiment shown in FIGS. 10-13 the inflation device 43 can inflate and dispense a continuous web of inflatable structures 10 held by an inflatable structure holder 42. Another such embodiment is shown in FIG. 16. In this embodiment, the holder 42 is designed to hold a continuous web of inflatable structures 10 that are in a folded form 47 and held by a pair of rods 48. These rods 48 are a type of mechanical registration device 40 that function similarly to the above described embodiments in that they help temporarily locate the valve 14 of the inflatable structure 10 proximate to the outlet 46 of a source of pressurized air 45 when an inflatable structure is pulled down from the holder 42.

However, alternate embodiments are contemplated such as the embodiments shown in FIGS. 14 and 15 wherein the inflatable structure 10 inflation device 43 is designed to fill inflatable structures which are packaged together in a cartridge 36. These embodiments can make use of an alternative type of an inflatable structure 10 holder 42 in the form of a clamp, which holds the inflatable structures together as a cartridge 36. The holder 42 can hold each of the inflatable structures 10 together by engaging a second edge portion 28 in the flexible film 11 that extends beyond a first edge portion 27 in the flexible film, as shown in FIGS. 14 and 15. This allows the valve 14 of the outermost inflatable structure 10 to remain exposed such that it can receive an air flow 32 exiting the outlet 46 of the source of pressurized air 45, and may further use the air flow to pin down at least a portion of the inflatable structure, such as the flexible film 11 extending from the second edge portion 28, during inflation. The holder 42 can also include one or more pins 49 holding the cartridges 36 together, as shown in FIG. 15. Additionally, the holder 42 can also comprise a diverter 50 so as to redirect the air flow 32 exiting the outlet 46 of the source of pressurized air 45 toward a valve 14 in the inflatable structure 10.

The methods of inflating the inflatable structures 10 will now be described. These methods of filling inflatable structures 10 do not necessitate physical contact between the outlet 46 of the source of pressurized air 45 and the inflatable structure 10. Further, the methods are herein meant to describe the use of air flow 32 that is either high pressure or low pressure. Low pressure air flow 32 refers to air flow which may be produced by a fan or blower or human-powered inflation (e.g., whistling or blowing), whereas high pressure air flow refers to compressed air.

While the inflation methods are herein described with respect to a particular order of steps, it is to be understood that such ordering will not necessarily be required, and that alternative ordering of steps and variations on the steps are possible. Further, for simplicity's sake, the inflation will generally be discussed in terms of inflating the inflatable structures 10 with air, although other gases or fluids such as water or liquid foodstuffs or medical products can be used.

Figure 11:
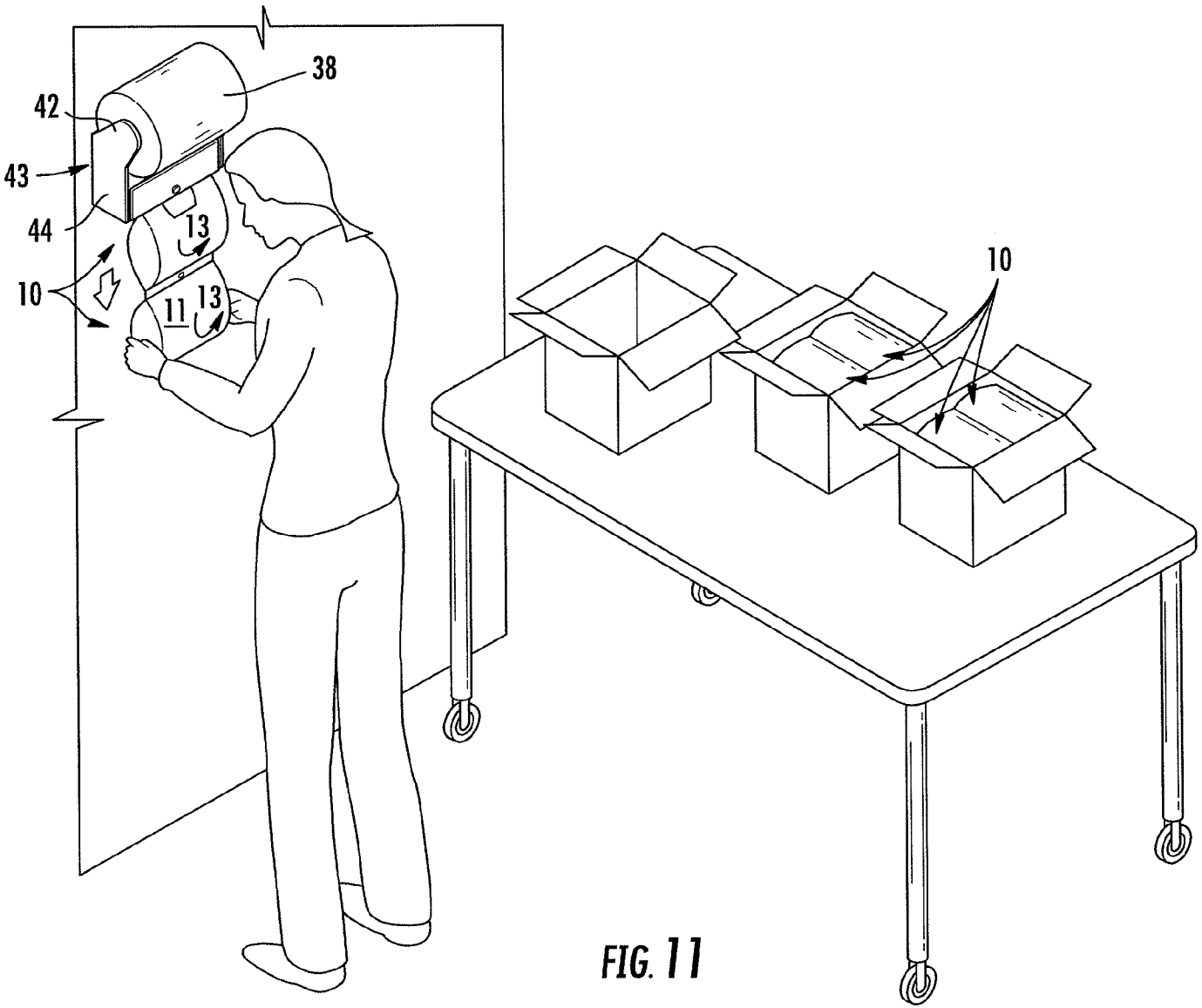
FIG. 11 is a perspective view of an embodiment of a wall-mounted roll-based inflatable structure inflation device in operation.
Figure 12:
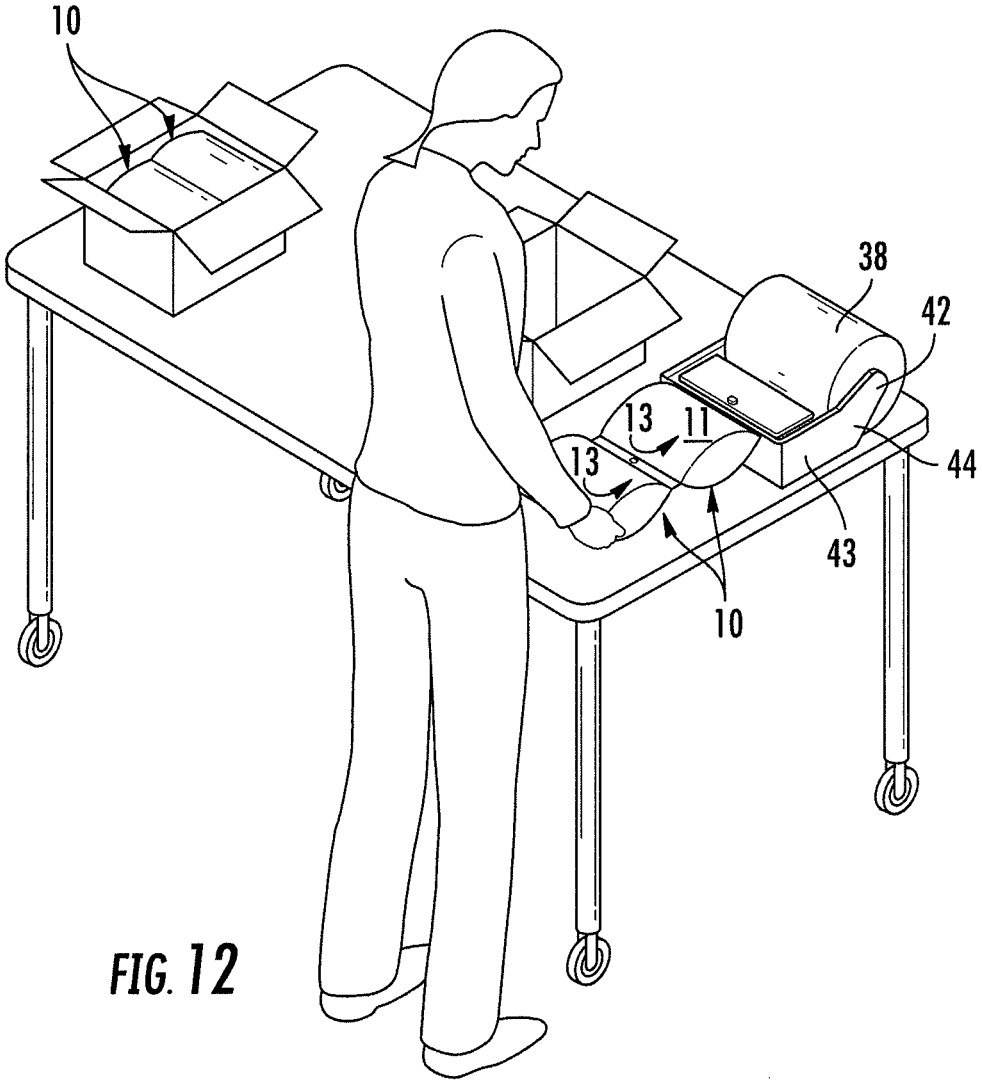
FIG. 12 is a perspective view of an embodiment of a table-mounted roll-based inflatable structure inflation device in operation

Additionally, the methods of inflating inflatable structures 10 are largely described in terms of manual human operation of the inflation device 43. However, the inflation device 43 may be fully or partially automated. For example, a drive motor may be used to feed the continuous web of inflatable structures 10 through the inflation device 43. The inflation device 43 may further be equipped with a controller that automatically fills the inflatable structures 10 with the desired amount of air. Furthermore, in some automatically driven embodiments, mechanical registration device 40 and locator apertures 16 may or may not be necessary, as the drive motor controller could stop the advance of the web of inflatable structures 10 to optimally allow for inflation. In particular, the drive motor could be commanded to stop with the valve 14 proximate to the outlet 46 of the source of pressurized air 45 when an optical sensor reads a visual indicator on the inflatable structure 10. Alternatively, the drive motor can be commanded to run slow enough to allow the inflatable structures 10 to fill without stopping for each inflatable structure. Also, the inflation device 43 may be oriented in a number of different ways. For example, the inflation device 43 may be wall-mounted, as shown in FIGS. 11 and 13, or table-mounted, as shown in FIG. 12.

With regard to the embodiments of the inflatable structure 10 inflation device 43 shown in FIGS. 10-13 and 16, their operation will now be described. An operator may first secure a continuous web of inflatable structures 10 with the holder 42. The operator can then turn on the source of pressurized air 45, which may constitute a blower. Next, the operator may pull on the first inflatable structure 10 until a valve 14 in the inflatable structure is proximate to the outlet 46 of the source of pressurized air 45. If the inflatable structure 10 inflation device 43 is equipped with a mechanical registration device 40 and the continuous web of inflatable structures is equipped with corresponding locator apertures 16, the continuous web of inflatable structures will stop when the mechanical registration device engages a locator aperture, and the inflatable structure inflation device is designed to have the outlet 46 of the source of pressurized air 45 proximate to the valve 14 at this point. Alternately, or additionally, the inflatable structure 10 or the inflation device 43 or both may have a visual indicator which reaches a point of optical alignment when the valve 14 is proximate to the outlet 46 of the source of pressurized air 45. Alternately, the operator may simply pull on the continuous web of inflatable structures 10 and not stop each time a valve 14 passes the outlet 46 of the source of pressurized air 45. This is possible when the source of pressurized air 45 emits sufficient air flow 32.

When the valve 14 and outlet 46 are thus proximate to each other, the source of pressurized air 45 will fill the inflatable structure 10 with air. "Proximate" here means that the valve 14 and the outlet 46 of the source of pressurized air 45 are located relative to one another such that an air flow 32 from the outlet reaches the valve and is able to penetrate the valve and enter into an enclosed chamber 13 in the inflatable structure 10, as shown in FIG. 8. As is the case throughout this application, the source of pressurized air 45 does not have to operate at a high pressure nor does the outlet 46 require contact with the inflatable structure 10. Instead, the source of pressurized air 45 may emit a low pressure air flow 32, and the outlet 46 may be physically separated from the inflatable structure 10. Once the inflatable structure 10 has reached the desired level of fullness, the operator can then either repeat the previous steps by pulling on the continuous web of inflatable structures to access the next inflatable structure, or the operator can tear the filled inflatable structure off from the remainder of the continuous web of inflatable structures. Filling of an inflatable structure 10 may substantially automatically lift the locator aperture 16 off of the mechanical registration device 40 such that the inflation device 43 is ready to advance the continuous web of inflatable structures 10 and fill the next inflatable structure 10. Also, the mechanical registration device 40 may be joined to the remainder of the inflation device 43 by a hinge or flexible connector such that the inflation of the inflatable structure 10 dislodges the mechanical registration device from the locator aperture 16.

The amount of air that fills the inflatable structure 10 may be controlled in a number of ways. One such method is by visual inspection of the inflatable structure 10 whereby the operator would remove the inflatable structure from proximity with the outlet 46 of the source of pressurized air 45 when the inflatable structure is filled with the desired amount of air. Alternatively, the inflatable structure 10 may automatically release from the inflation device 43 when the mechanical registration device 40 dislodges from the locator aperture 16 upon the filling of the inflatable structure, as discussed above. An alternative or additional way of controlling the level of inflation is to use inflation restriction structures to control the dimensions of the inflatable structure 10 as it inflates. Inflation restriction structures can take the form of plates or bars between which the inflatable structures 10 inflate. As the inflatable structures 10 fill, the inflation restriction structures can restrict the dimensional expansion of the inflatable structures, and hence limit the amount of air that fills the inflatable structures.

With regard to the embodiments of the inflation device 43 shown in FIGS. 14, and 15, the method of operation will now be described. In these embodiments, the operation may begin by placing a cartridge 36 of inflatable structures 10 in the holder 42. The inflatable structures 10 may be connected to one another prior to insertion in the holder 42, as through use of a staple, heat seal, or adhesive, or the holder can operate to clamp them together. The operator may then turn on the source of pressurized air 45, which results in an air flow 32. The outlet 46 of the source of pressurized air 45 can be aimed at the valve 14 of the outermost inflatable structure 10. Alternatively it may be aimed at the holder 42, which can comprise a diverter 50 to direct the air flow 32 toward the valve 14 of the outermost inflatable structure 10. When the inflatable structure 10 has reached the desired level of fullness, the operator then removes the inflatable structure. Removing the filled inflatable structure 10 may involve pulling the inflatable structure out from the holder 42. The process can then be repeated to inflate additional inflatable structures 10.

Figure 17:
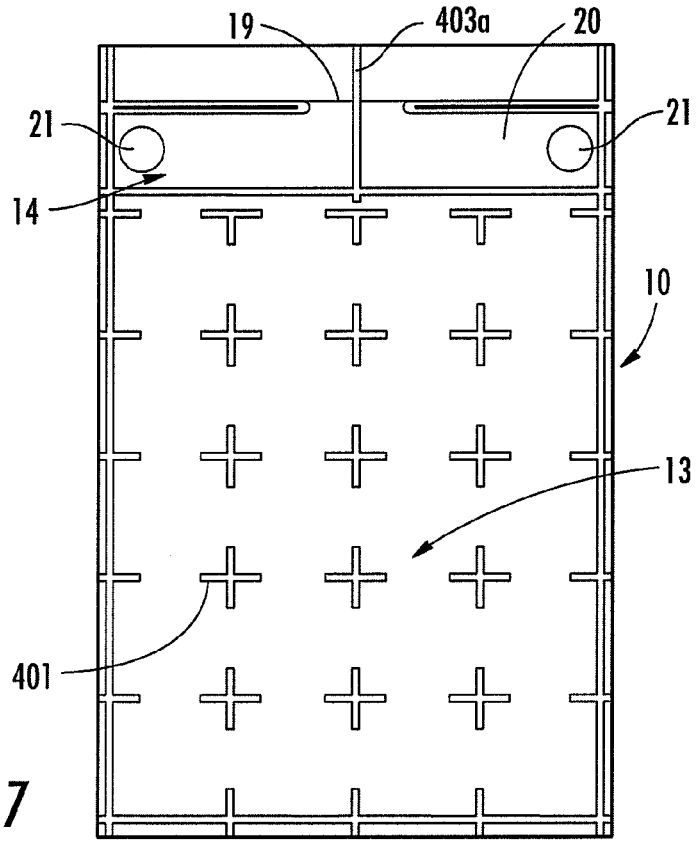
FIG. 17 is a top view of an embodiment of an inflatable structure having two internal valve openings, a plurality of quilting seals, and a straight valve position-retention seal.

Many additional embodiments of inflatable structures and associated apparatuses and methods are provided. For example, FIG. 17 illustrates an embodiment of an inflatable structure 10 comprising two internal valve openings 21. Use of two internal valve openings 21 may allow for more rapid inflation of the inflatable structure 10 by providing multiple paths through which air may travel in order to inflate the enclosed chamber 13.

Figure 19:
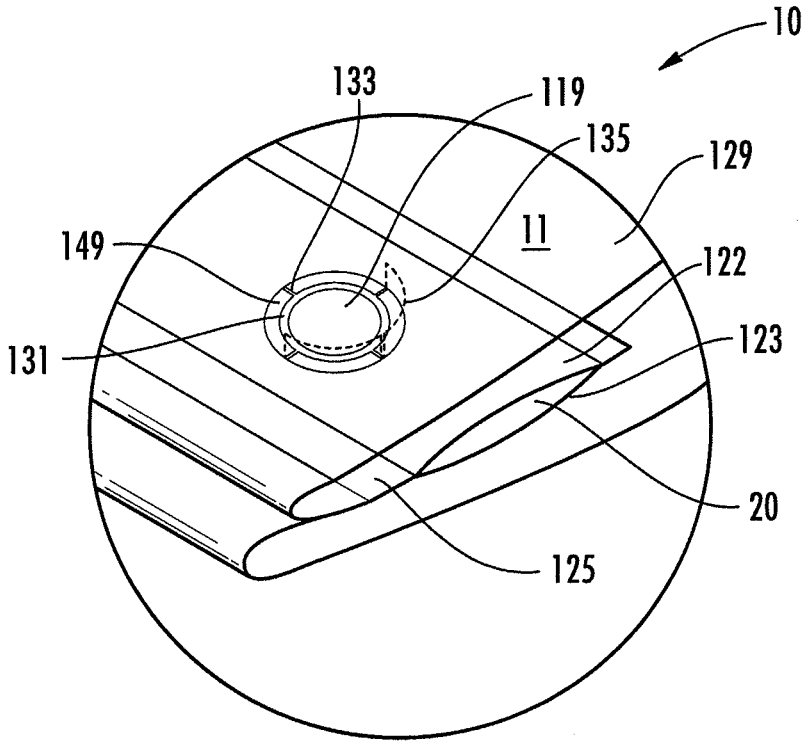
FIG. 19 is a partial sectional view of an embodiment of an inflatable structure with an external valve opening extending through multiple layers of flexible film and comprising sail cuts.
Figure 20:
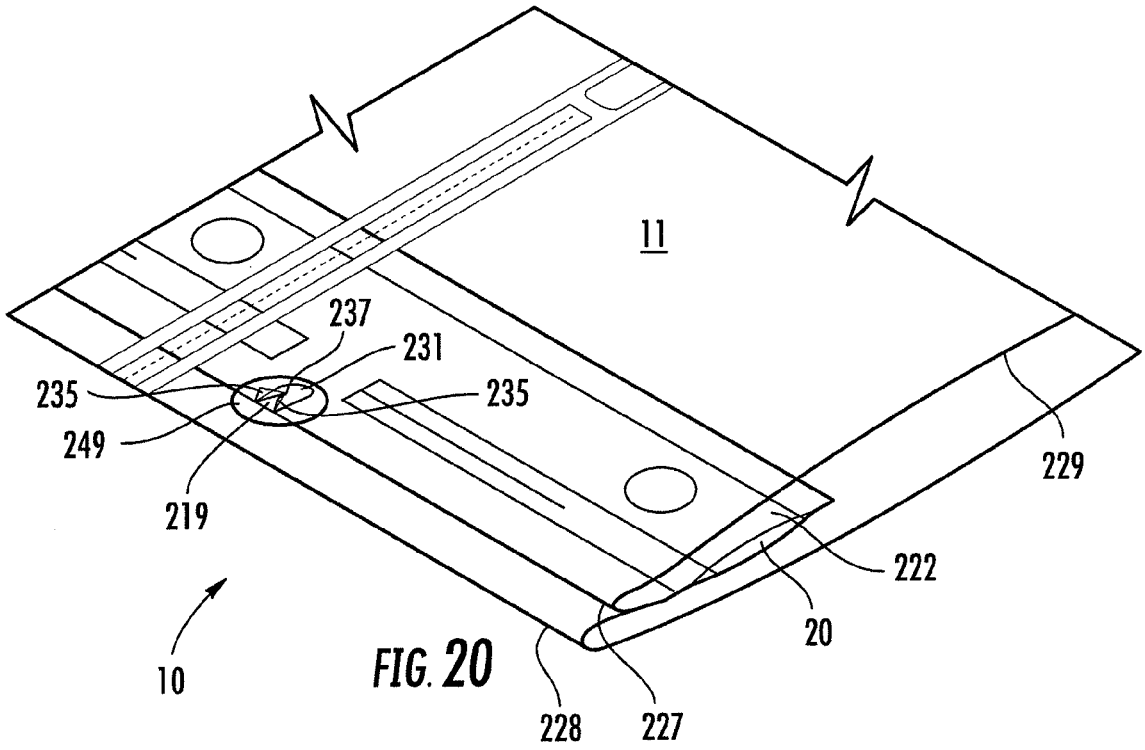
FIG. 20 is a partial perspective view of an embodiment of an inflatable structure with an external valve opening comprising a slit extending though multiple layers of flexible film, and which is also defined by edge portions formed by folding the flexible film.
Figure 21:
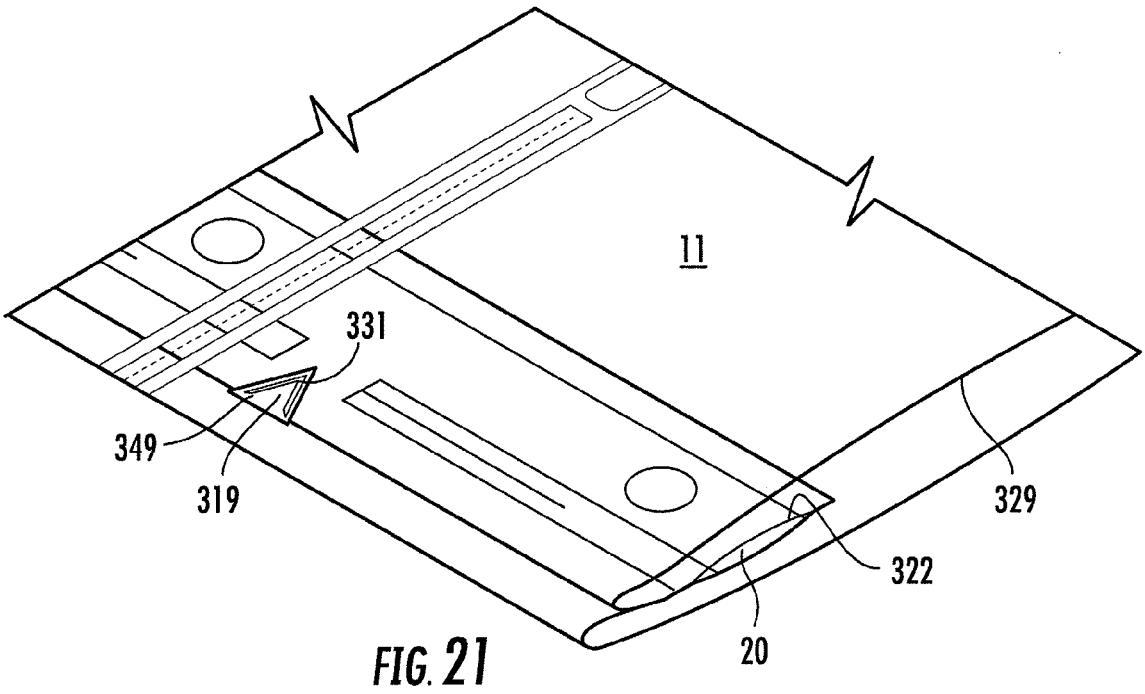
FIG. 21 is a partial perspective view of an embodiment of an inflatable structure with a v-shaped external valve opening extending though multiple layers of flexible film, and which is also defined by edge portions formed by folding the flexible film.

Alternatively or additionally, embodiments of inflatable structures may comprise different types of external valve openings from those previously described. For example, FIG. 19 illustrates a partial view of an embodiment of an inflatable structure 10 comprising an external valve opening 119, which may be circular, extending through multiple layers of flexible film 11. In particular, the external valve opening 119 extends through a first layer 129 of the flexible film 11 and a second layer 122 of the flexible film. Note that the first and second layers referenced in embodiments wherein the external valve opening at least partially extends through the first and second layers (as illustrated in FIGS. 19-21) refer to the layers extending from an edge portion (see, e.g., layers 222 and 229 extending from edge portion 227 in FIG. 20) as opposed to those extending from an internal edge portion as described in other embodiments (see, e.g., layers 29 and 30 extending from internal edge portion 24 in FIG. 1). To prevent air from leaking out between the first layer 129 and the second layer 122 at the external valve opening 119, these two layers can be sealed together surrounding at least a portion of the external valve opening.

One method of sealing the first layer 129 and the second layer 122 of flexible film 11 together involves applying heat resistant ink 149 in the channel 20. Thereafter, the first layer 129 and the second layer 122 may be sealed together by heat sealing to form a seal 131, with the external valve opening 119 created through methods such as melting through the first and second layers. Thus, the resulting external valve opening 119 may have a different orientation than the above-described embodiments of external valve openings. Accordingly, inflation of the inflatable structure 10 may be accomplished from different angles than the above-described embodiments. As a result of extending the external valve opening 119 through the first layer 129 and the second layer 122 of the flexible film 11, the seal 125 between the second layer and a third layer 123 of the flexible film may be made continuous, because the air which inflates the inflatable structure 10 enters through a different direction. Additionally, the external valve opening 119 may be provided with sail cuts 133 which extend through the seal 131. The sail cuts 133 create one or more sails 135 which may lift in response to a flow of air and thereby facilitate inflation of the inflatable structure 10. In particular, they can be useful in overcoming any stickiness created by the heat resistant ink 149 in the channel 20.

Embodiments of external valve openings extending partially through multiple layers of the flexible film are also provided. One such embodiment, as illustrated in FIG. 20 is that of an inflatable structure 10 wherein the external valve opening 219 extends through first 229 and second 222 layers of the flexible film 11, but the external valve opening is also defined by edge portions 227, 228 of the flexible film which are formed by folding the flexible film. In such embodiments of the inflatable structure 10, the external valve opening 219 may comprise a slit 237 extending through the first 229 and second 222 layers of the flexible film 11. The slit 237 creates two sails 235 which may lift in response to a flow of air and thereby facilitate inflation of the inflatable structure 10 through the external valve opening 219 similarly to as described above. In an alternative, but otherwise similar embodiment, as illustrated in FIG. 21, the external valve opening 319 may be v-shaped.

Regardless of the particular shape of the external valve opening 119, 219, 319, the external valve opening can comprise a seal 131, 231, 331 as described above surrounding at least a portion of the external valve opening. In particular, the seal 131, 231, 331 can seal together the first 129, 229, 329 and second 122, 222, 322 layers of flexible film 11 around the portion of the external valve opening 119, 219, 319 that extends through the first and second layers of flexible film. Creation of the seal 131, 231, 331 may be facilitated as described above through use of a heat resistant ink 149, 249, 349 applied in the channel 20. Further, each of the above-described embodiments, as illustrated in FIGS. 19-21, are configured such that the external valve opening 119, 219, 319 defines an angle with respect to the channel 20. Thereby, the external valve opening 119, 219, 319 is positioned such that it is not substantially parallel with the channel 20, which such a relationship may assist in maintaining a seal once the inflatable structure 10 is inflated by forcing air within the inflatable structure to travel a tortuous path in order to exit the inflatable structure.

Figure 22:
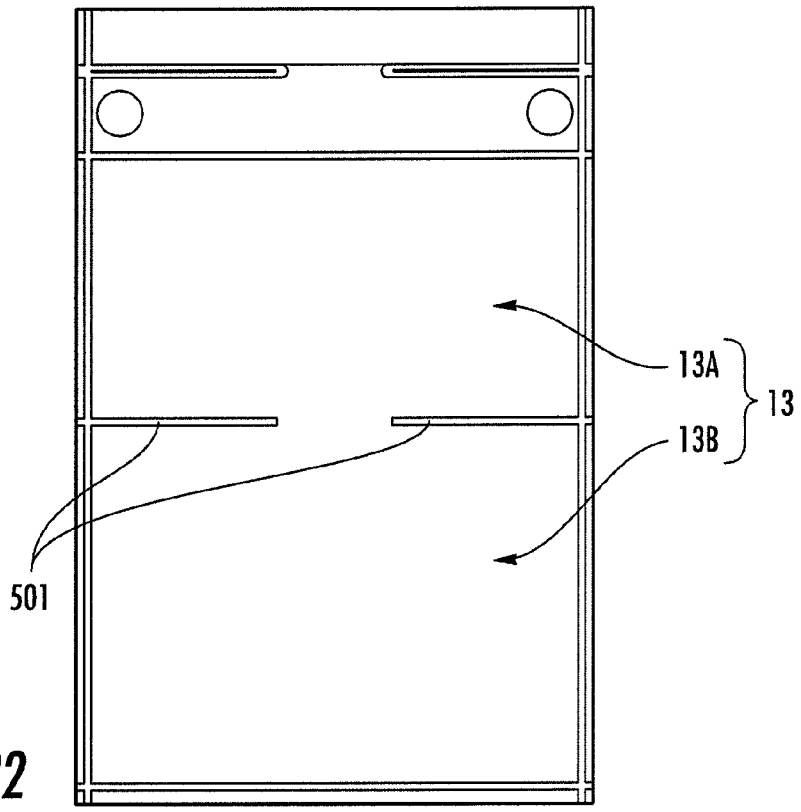
FIG. 22 is a top view of an embodiment of an inflatable structure comprising quilting seals separating the enclosed chamber into two partially enclosed chambers.
Figure 23:
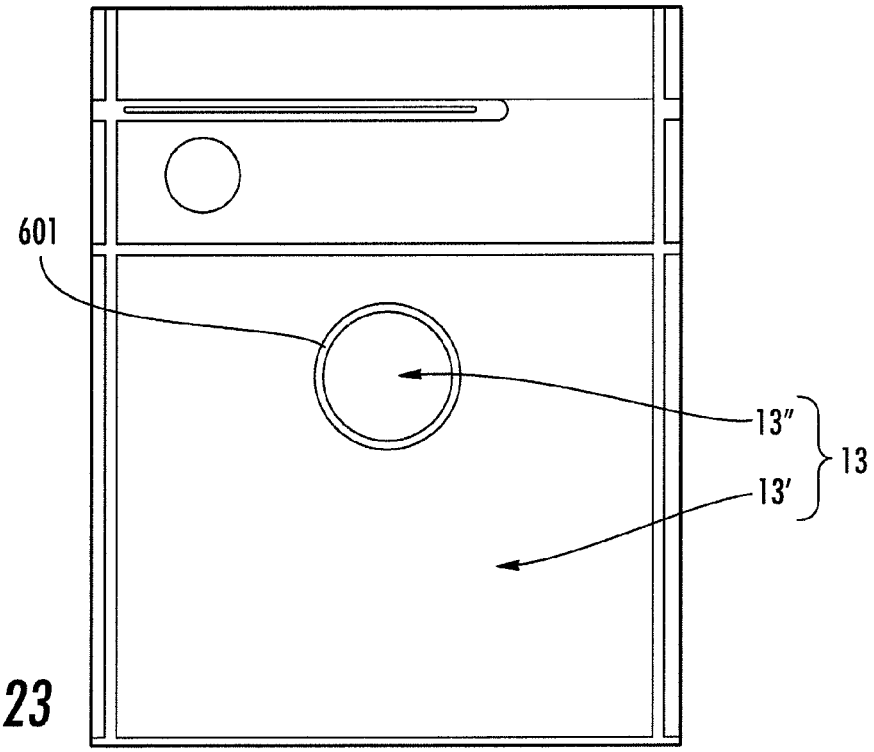
FIG. 23 is a top view of an embodiment of an inflatable structure comprising quilting seals separating the enclosed chamber into an inflatable chamber and an uninflatable chamber.

Embodiments of the above-described inflatable structures may further include additional features. For example, returning to FIG. 17, this embodiment of an inflatable structure 10 comprises a plurality of quilting seals 401 connecting sidewalls 29, 30 defining the enclosed chamber 13 (see, e.g. FIG. 1). This particular embodiment of quilting seals 401 produces a quilted bubble pattern when inflated. However, other patterns may be created. For example, FIG. 22 illustrates an embodiment in which quilting seals 501 separate the enclosed chamber 13 into two partially enclosed chambers 13A, 13B. Additional embodiments, such as the embodiment illustrated in FIG. 23 use one or more quilting seals 601 to divide the enclosed chamber 13 into one or more inflatable chambers 13' and one or more uninflatable chambers 13".

Figure 18:
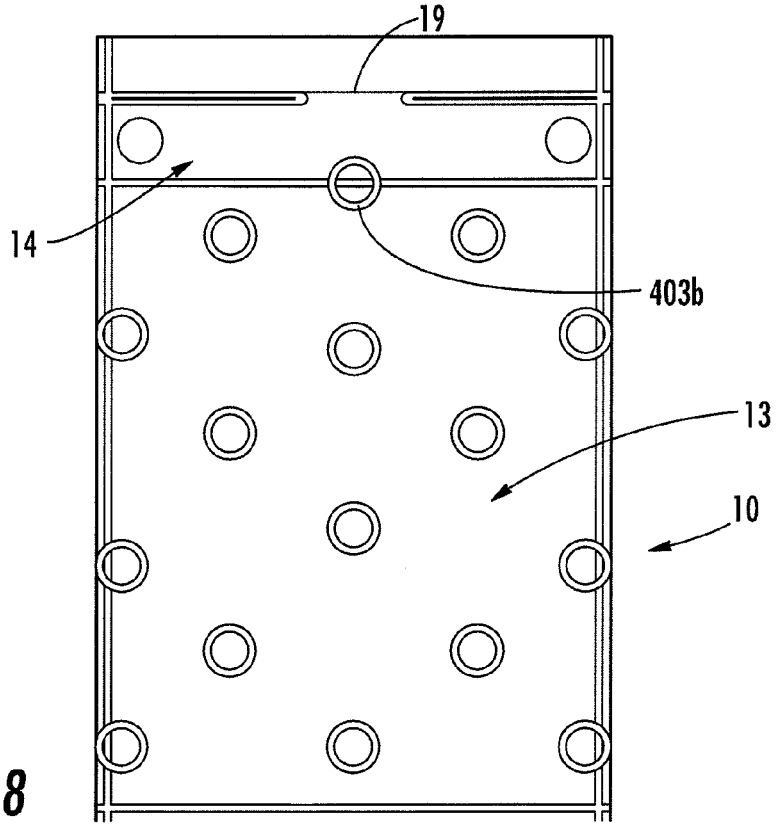
FIG. 18 is a top view of an embodiment of an inflatable structure having a circular valve position-retention seal.

Further embodiments of inflatable structures may include one or more valve position-retention seals configured to retain the position of the one-way valve. Valve position-retention seals help to prevent a portion of the one-valve from possibly pushing out of the external valve opening by connecting the one-way valve to the sidewalls defining the enclosed chamber. One embodiment of a valve position-retention seal 403*a* is illustrated in FIG. 17. The valve position-retention seal 403*a* seals together all of the layers of the inflatable structure 10 through the external valve opening 19, the channel 20, and the inflatable chamber 13. By sealing together all of the layers forming the inflatable structure 10, the one-way valve 14 is connected to the sidewalls 29, 30 (see, e.g. FIG. 1) forming the inflatable chamber 13, and hence this resists against the one-way valve being forced out of the external valve opening 19. An alternate embodiment of a valve position-retention seal 403*b* is illustrated in FIG. 18. In this embodiment the valve position-retention seal 403*b* comprises a circular shape, instead of the straight line shape of the embodiment of a valve position-retention seal 403*a* illustrated in FIG. 17. By sealing through all of the layers of the inflatable structure 10 such that the one-way valve 14 is sealed to the sidewalls 29, 30 (see, e.g. FIG. 1) as in the previously-described embodiment, the valve position-retention seal 403*b* may still retain the position of the one-way valve such that it may not be pushed out of the external valve opening 19 by pressure within the inflatable chamber 13.

Figure 24:
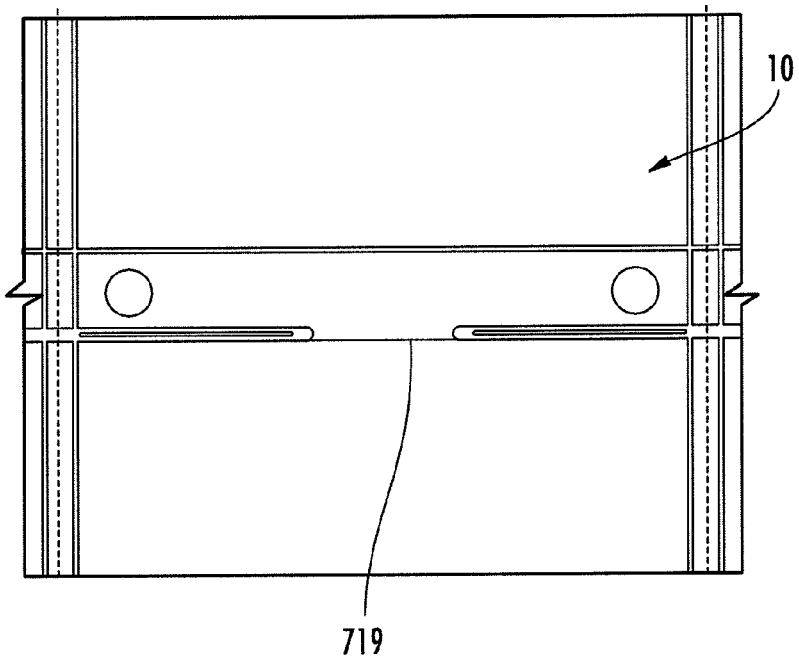
FIG. 24 is a top view of an embodiment of an inflatable structure having an external valve opening configured to be aligned with an opening in a container.
Figure 25:
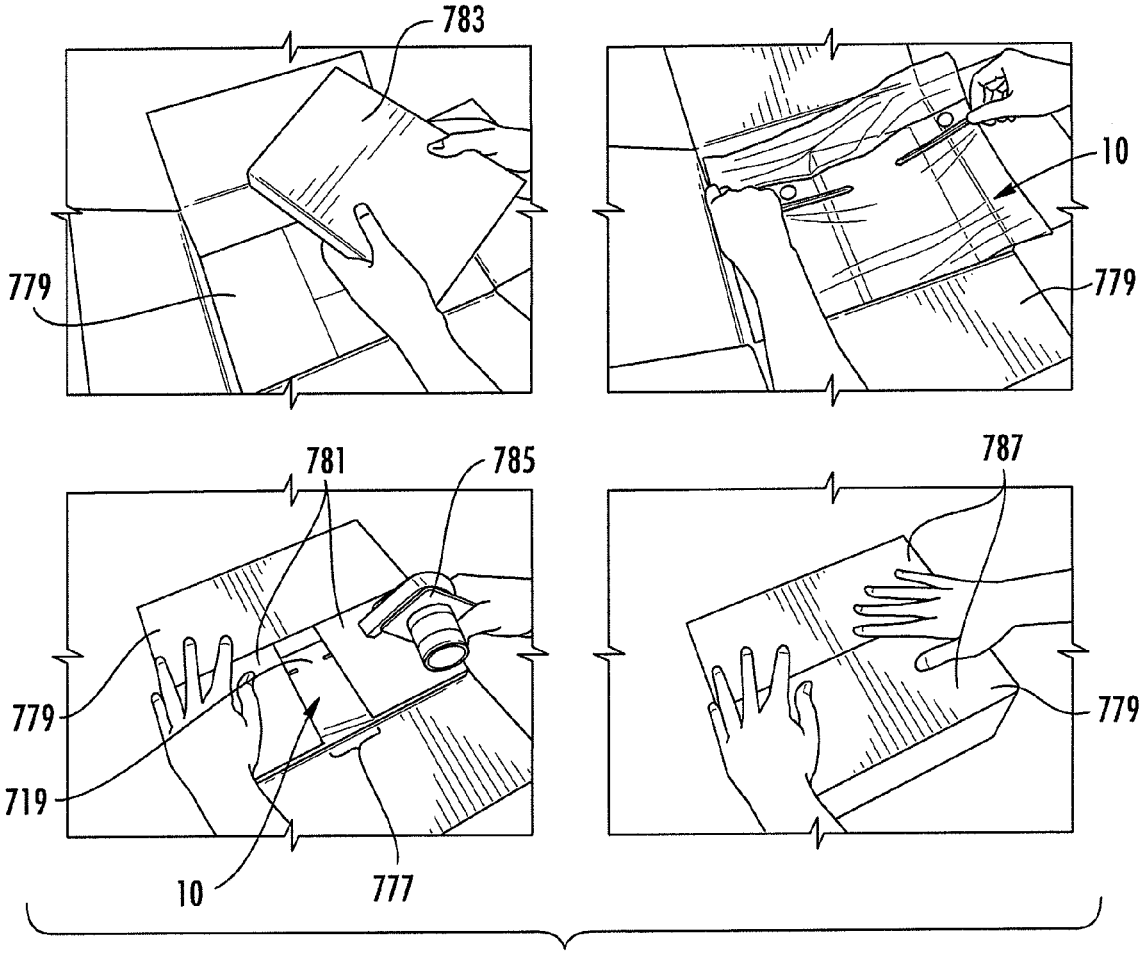
FIG. 25 is a sequence of steps illustrating packaging an item in a container using the inflatable structure of FIG. 24.

Embodiments of inflatable structures may also comprise features which facilitate their use as packaging in a container, such as a cardboard box. One such embodiment of an inflatable structure 10 is illustrated in FIG. 24. This inflatable structure 10 comprises an external valve opening 719 configured to be aligned with an opening 777 in a container 779 when the inflatable structure is placed in the container 779 (see FIG. 25). In the illustrated embodiment, the opening 777 is a space between flaps 781 which comprise portions of the container 779. As will be described below, aligning the external valve opening 719 with an opening 777 in the container 779 facilitates inflation of the inflatable structure 10 within the container 779.

A method of inflating inflatable structures for use in packaging an item in a container utilizing a source of pressurized air is also provided. The method comprises placing an inflatable structure 10 in a container 779 in proximity to the item 783 to be packaged and spaced at a distance from the source of pressurized air 785. In the illustrated embodiment, the item 783 to be packaged is placed first in the container 779, with the inflatable structure 10 on top, though other packaging orientations are possible. The method further comprises filing the inflatable structure 10 with a desired amount of air from the source of pressurized air 785. This may involve filling the inflatable structure 10 with air until the container 779 is substantially devoid of empty space, or the item 783 is securely fixed in place. In some embodiments the method may further comprise closing one or more flaps 781 of the container 779 prior to the step of filling the inflatable structure 10. This assists the user in determining when the container 779 is devoid of empty space. The method may additionally comprise aligning the external valve opening 719 of the inflatable structure 10 with the remaining open portion 777 of the container 779 which is created by the step of closing the flaps 781. By aligning the external valve opening 719 in this manner, inflation of the inflatable structure 10 is facilitated. For example, the source of pressurized air 785 may then be positioned outside of the container 779. Once the inflatable structure 10 is inflated, any remaining flaps 787 may be closed, and the container 779 may then be sealed.

Figure 26:
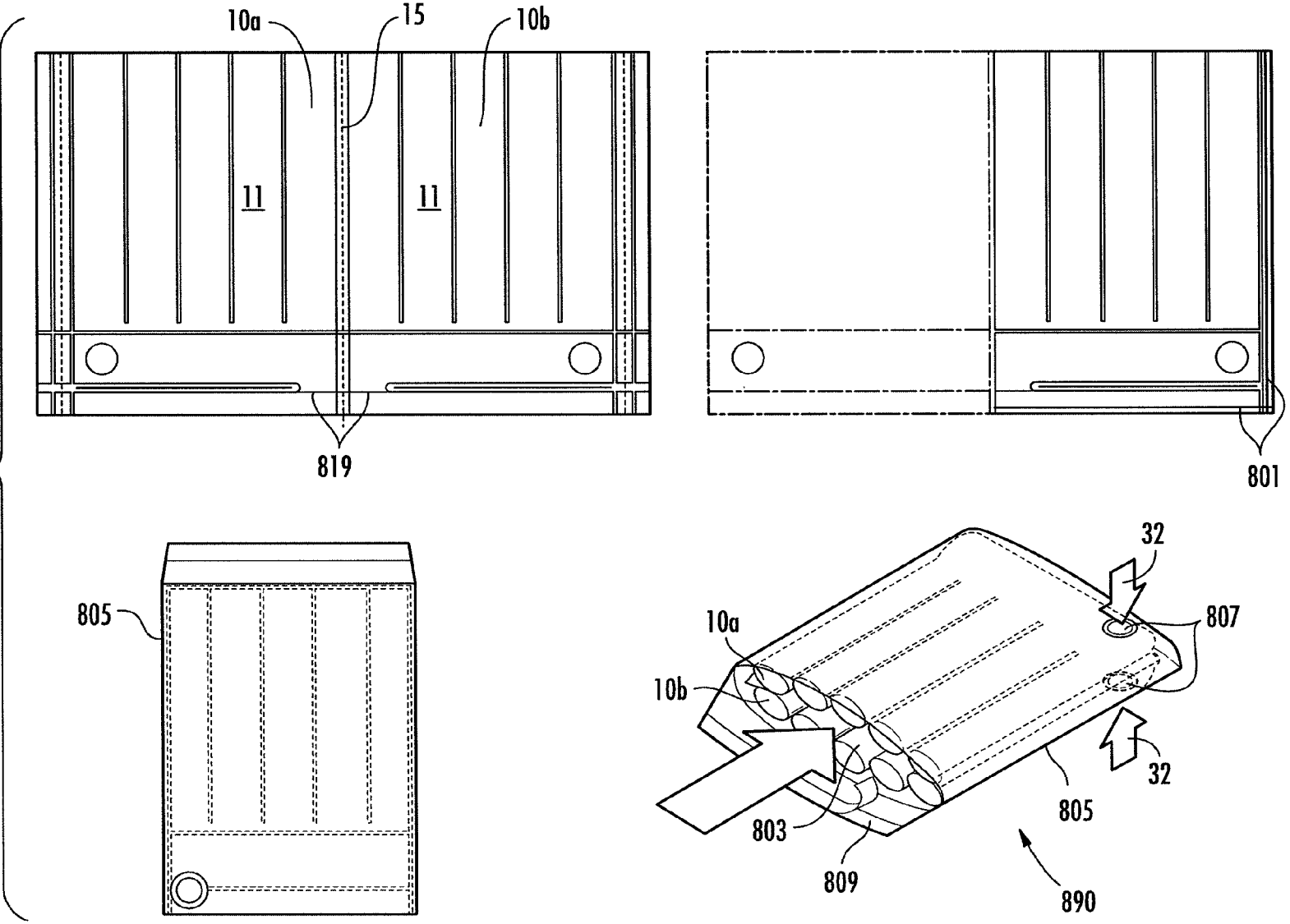
FIG. 26 illustrates multiple views of an inflatable assembly.

Additional embodiments of the invention comprise an inflatable assembly for use in packaging. FIG. 26 illustrates a first inflatable structure 10*a* and a second inflatable structure 10*b* which may comprise parts of the inflatable assembly 890. The inflatable structures 10*a*, 10*b* may be similar to the above-described inflatable structures and may be formed by the same or similar methods. However, the inflatable structures 10*a*, 10*b* may further comprise one or more connecting seals 801 connecting the first inflatable structure and the second inflatable structure. In order to seal the inflatable structures 10*a*, 10*b* together the flexible film 11 may first be folded proximate one of the perimeter seals 15, with the two inflatable structures then sealed together with the connecting seals 801. The connecting seals 801 create a partially enclosed cavity 803 between the first inflatable structure 10*a* and the second inflatable structure 10*b*. As further illustrated in FIG. 26, the inflatable structures are inserted into an outer pouch 805 with at least one inflation aperture 807 therethrough. The inflation apertures 807 align with external valve openings 819 in the inflatable structures 10*a*, 10*b* when the inflatable structures are inserted into the outer pouch 805. Thus, air 32 can be directed through the inflation apertures 807 in the outer pouch 805 and into the external valve openings 819 to thereby inflate the inflatable structures 10*a*, 10*b*. This may occur after an item is inserted into the partially enclosed cavity 803 and a flap 809 is closed, in order to securely package the item in the inflatable assembly 890.

Figure 27:
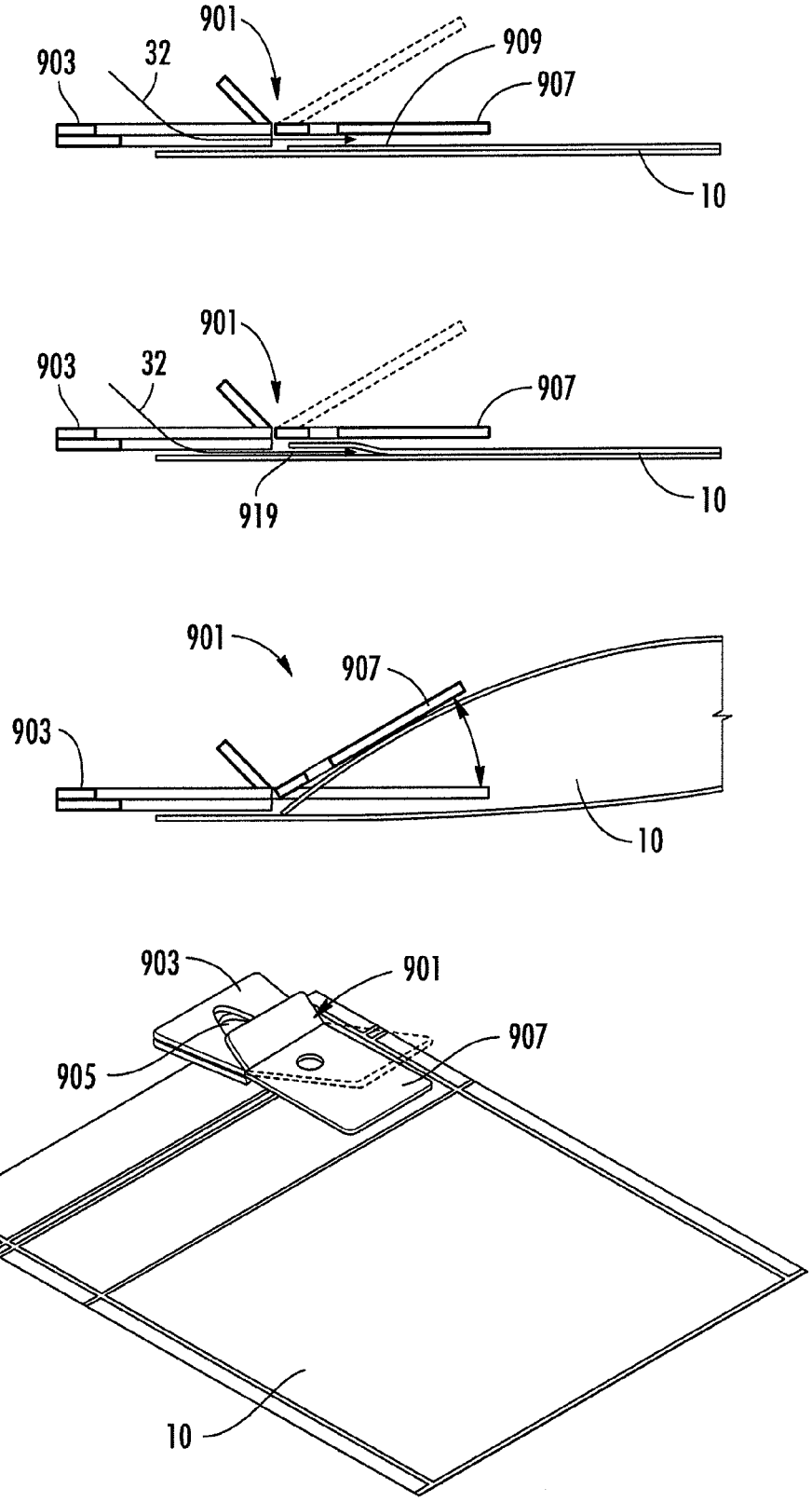
FIG. 27 illustrates multiple views of an apparatus configured to facilitate inflation of an inflatable assembly.

An additional embodiment of the invention comprises an apparatus configured to facilitate inflation of inflatable structures. As illustrated in FIG. 27, the apparatus 901 comprises a base plate 903 with an aperture 905 therethrough, and a hinged plate 907 hingedly connected thereto. The aperture 905 is configured to direct a flow of air 32 through the aperture 905 and toward an external valve opening 919 and an outer surface 909 of an inflatable structure 10. The flow of air 32 creates an area of low pressure between the outer surface 909 of the inflatable structure 10 and the hinged plate 907, which aids in opening the external valve opening 919. As a secondary function, the hinged plate 907 may be configured to actuate a switch (not shown) which shuts off the flow of air 32 when the hinged plate hingedly pivots as a result of the inflatable structure 10 filling with air. Accordingly, the flow of air 32 may be automatically stopped when the inflatable structure 10 is filled to a desired thickness.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An inflatable structure for use in packaging comprising:

at least one flexible film defining an enclosed chamber, wherein the enclosed chamber is defined between a first sidewall and a second sidewall of the at least one flexible film; and at least one one-way valve defined at least in part by first and second layers of the flexible film for receiving pressurized air and thereby inflating the enclosed chamber, the first and second layers of flexible film at least partially extending between the flexible film's first sidewall and second sidewall, wherein the one-way valve comprises a plurality of internal valve openings and an external valve opening that is defined at least in part by edge portions of the first and second layers of the flexible film, wherein the edge portions of the first and second layers of the flexible film are formed by folding the flexible film, wherein the one-way valve further comprises an internal edge portion comprising a fold in the flexible film, wherein the one-way valve further comprises an inflation channel defined between the first and second layers of the flexible film, the inflation channel extending between the external valve opening and plurality of internal valve openings; and wherein the one-way valve further comprises a valve position-retention seal that seals together the first sidewall and the second sidewall of the enclosed chamber and seals together the first and second layers of the flexible film of the one-way valve, the valve position-retention seal being positioned between at least two of the internal valve openings in the inflation channel of the one-way valve.

2. The inflatable structure of claim 1, wherein the external valve opening defines an angle with respect to the channel.

3. The inflatable structure of claim 1, wherein the valve-position retention seal is circular.

4. The inflatable structure of claim 1, further comprising one or more quilting seals through the first sidewall and the second sidewall of the enclosed chamber.

5. The inflatable structure of claim 1, wherein the valve-position retention seal is a straight line.

6. The inflatable structure of claim 1, wherein the external valve opening comprises a slit extending through the first and second layers of the flexible film.

7. The inflatable structure of claim 1, wherein the external valve opening is v-shaped.

* * * * *